US009785110B2

(12) United States Patent
Wei et al.

(10) Patent No.: US 9,785,110 B2
(45) Date of Patent: Oct. 10, 2017

(54) DEVELOPING CARTRIDGE

(71) Applicant: Ninestar Corporation, Zhuhai (CN)

(72) Inventors: Shengyu Wei, Zhuhai (CN); Jianxin Cao, Zhuhai (CN); Lai Luo, Zhuhai (CN); Huashen Lin, Zhuhai (CN); Zhongli Yin, Zhuhai (CN); Wanhong Huang, Zhuhai (CN); Chao Wang, Zhuhai (CN); Peng Wang, Zhuhai (CN)

(73) Assignee: NINESTAR CORPORATION, Zhuhai (CN)

( * ) Notice: Subject to any disclaimer, the term of this patent is extended or adjusted under 35 U.S.C. 154(b) by 0 days.

(21) Appl. No.: 15/181,977

(22) Filed: Jun. 14, 2016

(65) Prior Publication Data

US 2016/0349697 A1 Dec. 1, 2016

Related U.S. Application Data

(63) Continuation of application No. PCT/CN2014/092900, filed on Dec. 3, 2014.

(30) Foreign Application Priority Data

Dec. 18, 2013 (CN) ..... 2013 2 0838368 U
Aug. 22, 2014 (CN) ..... 2014 2 0479297 U
Oct. 31, 2014 (CN) ..... 2014 1 0608971

(51) Int. Cl.
*G03G 15/00* (2006.01)
*G03G 21/16* (2006.01)
(Continued)

(52) U.S. Cl.
CPC ..... *G03G 21/1652* (2013.01); *G03G 15/0863* (2013.01); *G03G 15/0865* (2013.01);
(Continued)

(58) Field of Classification Search
CPC ..... G03G 2221/166; G03G 21/1652; G03G 21/1853; G03G 15/0896; G03G 15/0865
(Continued)

(56) References Cited

U.S. PATENT DOCUMENTS

2003/0123896 A1* 7/2003 Goto ..... G03G 21/1871 399/90
2013/0022367 A1* 1/2013 Choi ..... G03G 21/1867 399/90

FOREIGN PATENT DOCUMENTS

CN 102012667 A 4/2011
CN 202018562 U 10/2011
(Continued)

OTHER PUBLICATIONS

The World Intellectual Property Organization (WIPO) International Search Report for PCT/CN2014/092900 dated Mar. 3, 2015.

*Primary Examiner* — Walter L Lindsay, Jr.
*Assistant Examiner* — Jessica L Eley
(74) *Attorney, Agent, or Firm* — Anova Law Group, PLLC

(57) ABSTRACT

The present invention provides a developing cartridge, including a chip and conductive connecting pieces, provided on the developing cartridge, a cover of a printer is provided with chip contact heads, where one end of each of the conductive connecting pieces is connected to a chip terminal, and when the developing cartridge is inserted into the printer and the cover is closed, the other end of the conductive connecting piece contact with side surface of the chip contact head on the cover and squeezes the developing cartridge, preventing the developing cartridge from vibrating up and down during use.

17 Claims, 20 Drawing Sheets

(51) Int. Cl.
*G03G 21/18* (2006.01)
*G03G 15/08* (2006.01)

(52) U.S. Cl.
CPC ..... *G03G 21/1853* (2013.01); *G03G 21/1867* (2013.01); *G03G 21/1875* (2013.01)

(58) Field of Classification Search
USPC ..... 399/119
See application file for complete search history.

(56) References Cited

FOREIGN PATENT DOCUMENTS

| | | | |
|---|---|---|---|
| CN | 202975595 | U | 6/2013 |
| JP | 10198146 | A | 7/1998 |

* cited by examiner

DEVELOPING CARTRIDGE

CROSS-REFERENCE TO RELATED APPLICATION

The present application is a continuation of International Application No. PCT/CN2014/092900, filed on Dec. 3, 2014, which claims the priority to and benefits Chinese Patent Application No. 201320838368.6, filed on Dec. 18, 2013, Chinese Patent Application No. 201420479297.X, filed on Aug. 22, 2014, Chinese Patent Application No. 201410608971.4, filed on Oct. 31, 2014, the content of all of which is incorporated by reference herein.

TECHNICAL FIELD

The present invention relates to a developing cartridge.

BACKGROUND

Currently, known developing cartridges are divided into two types, that is, an integral cartridge and a divided cartridge. The divided cartridge needs to be matched with a drum assembly and then is installed into a laser printer together with the drum assembly, and then it can be normally used. This type of developing cartridge (that is, the divided cartridge) generally includes at least: a cartridge body, a supply roller, a doctor blade, a developing roller and a memory unit. The developing cartridge realizes data communication by direct contact between a terminal of the memory unit and a terminal contact point on the laser printer.

FIG. 1-FIG. 4 show a structure of a developing cartridge used in the prior art. Reference may be made to FIG. 1-FIG. 4, a developing cartridge 100 (100K, 100C, 100M, 100Y) is detachably installed into the main body 10 of a laser printer 1 along an installation direction A, where the developing cartridge 100 includes a cartridge body 110, a power reception unit 170 is provided on the end of one side of the cartridge body 110 close to a developing roller 140, a driving force reception unit 160 is provided on the end of the other side of the cartridge body 110 close to the developing roller 140, and a memory unit 180 is then provided on a back surface 101 of the cartridge body 110 of the developing cartridge 100 along the installation direction A of the developing cartridge 100, the memory unit is closer to the power reception unit 170 in relative to the driving force reception unit 160 and the memory unit 180 is provided with four terminals 181.

With reference FIG. 3, the terminal contact point 13 on a cover 11 of the laser printer includes an end surface 131 and a side surface 132.

When the developing cartridge 100 is installed into the main body 10 of the laser printer 1 and the cover 11 is closed, the terminals 181 of the memory unit 180 come into contact with the front end surfaces 131 of the terminal contact points 13 on the cover 11. As shown in FIG. 3, a circuit board 111 is provided inside the cover 11, and the electrical connections between the terminal contact points 13 on the cover 11 and the circuit board 111 are achieved via a spring 14. A press member 12 is provided on the cover 11 and is juxtaposed with the terminal contact point 13 at a certain distance, and when the cover 11 is closed, the press member 12 imposes a forward push force on the developing cartridge 100 installed in the main body 10, which may restrict the developing cartridge 100 from shifting forward and backward.

When the laser printer 1 starts to work, electrical contact parts 171 of the power reception unit 170 of the developing cartridge 100 are connected to the main body 10 to perform electrical conduction, a connecting gear 161 of the driving force reception unit 160 of the developing cartridge 100 is engaged with a power transmission gear 81 on the main body 10 to bring a driving force, then the connecting gear 161 is engaged with a developing roller gear 162 to perform power transmission, and the terminals 181on the back surface 101 of the developing cartridge 100 come into contact with the end surfaces 131 of the terminal contact points on the cover 11 to perform data communication.

Based on the prior art as described above, we know that the memory unit generally has two sides, where the front side is disposed with terminals that come into contact with the terminal contact points on the cover of the laser printer directly, and the reverse side is disposed with a memory as well as a capacitor, a resistor or other electronic components that are connected to the memory. When the terminals on the front side of the memory unit come into contact with the terminal contact points on the cover directly, the terminal contact points on the cover squeeze the memory to some degree to enable those electronic components welded onto the reverse side of the memory unit to become deformed or displaced due to the squeeze, thus the memory unit cannot work normally or even gets damaged, thereby affecting the developing cartridge to perform communications with the laser printer via the memory unit.

When a plurality of developing cartridges is installed into the main body of the laser printer together, there will be a certain gap between the developing cartridges. Moreover, the developing cartridges usually enter and exit from the main body of the laser printer by the cooperation of a pair of or pairs of guide rail protrusions on two side plates of the developing cartridges with guide rails at two corresponding inner sides of the main body of the laser printer, and in order to easily install the developing cartridges into the printer and easily remove them from the printer, the guide rail protrusions on the developing cartridges must be in clearance fit with the guide rails inside the main body of the laser printer, in this case, when the laser printer starts to work, a driving force will cause the developing cartridges to vibrate up and down between guide clearances, this will bring about effects in two aspects: in one aspect, due to small contact areas between the terminals of the memory unit on back surfaces of the developing cartridges and the end surfaces of the terminal contact points on the cover, when the developing cartridges are vibrating up and down, elastic elongating and shortening of the end surfaces of the terminal contact points are only in front and back directions, and has no limitation on the upward and downward vibrations of the developing cartridges, this will cause up and down misplacements between the terminals of the memory unit and the terminal contact points on the cover, leading to unstable contact, and finally affecting communications between the developing cartridges and the laser printer; in the other aspect, since the developing rollers and photo-sensitive drums perform regular rotations under a driving force, vibration of the developing cartridges will increase unnecessary shifting between the developing rollers and the photo-sensitive drums, this will be bound to affect the developing process, and finally affect printing quality.

For this reason, people hopes to have a developing cartridge, which not only is capable of providing good contacts and stable communications between terminals of the memory unit of the developing cartridge and terminal contact points on a cover, but also is capable of decreasing vibrations of the developing cartridge during a printing process, avoiding to affect the developing process and guaranteeing good printing quality.

SUMMARY

The present invention provides a developing cartridge to solve the technical problem that an existing developing cartridge is prone to vibration up and down during its use and there will be a poor contact between terminals of memory unit and end surfaces of terminal contact points on a cover.

In order to solve the above technical problem, the present invention uses the following technical solutions:

A developing cartridge detachably installed into a printer, wherein a cover of the printer is provided with a plurality of chip contact heads, each of the chip contact head includes an end surface and a side surface, the developing cartridge includes a cartridge body, and a chip and a plurality of conductive connecting pieces provided on the cartridge body, where the cartridge body includes an upper surface that is facing up and a back surface that is facing down when the developing cartridge is installed and inserted into the printer, one end of each of the conductive connecting piece is connected to the chip terminal, and when the developing cartridge is installed and inserted into the printer and the cover is closed, the other end of the conductive connecting piece comes into contact with the side surface of a corresponding chip contact head on the cover of the printer.

The conductive connecting pieces are provided on the upper surface of the cartridge body.

When the developing cartridge is installed, a rear end of the upper surface of the cartridge body is provided with a stepped surface with the rear end close to the chip contact heads on the cover, and the conductive connecting pieces are provided on the stepped surface.

The developing cartridge further includes a chip holder, where the chip holder is provided on the upper surface of the cartridge body, and the conductive connecting pieces and the chip are installed and fixed in the chip holder.

The developing cartridge further includes a limit posts, and receiving grooves, where the limit posts and the receiving grooves are successively provided on the upper surface of the cartridge body in compliance with rear ends of the conductive connecting pieces.

Each of the conductive connecting pieces includes: a rear end, a central I-shaped hole matching the limit post, and a protrusion in contact with the chip terminal.

Each of the conductive connecting pieces further includes: a front-end bend portion for securing the conductive connecting piece, and barbed teeth provided on the front-end bend portion.

The chip holder includes: a plurality of supporting platforms symmetrically provided at both ends of the chip holder, a plurality of limit blocks and baffles provided at sides adjacent to the supporting platforms, and slots of the conductive connecting pieces formed between adjacent limit blocks, where the limit blocks in the front of the chip holder and the baffles at three sides of the rear stand against the chip to restrict the chip from moving on all sides, the conductive connecting pieces are placed across the chip in turn, the front-end bend portions of the conductive connecting pieces are reversely inserted into the slots in the front of the chip holder in turn, the protrusions formed by stamping on the conductive connecting pieces are abutting joint with the chip terminals one by one, the central I-shaped holes of the conductive connecting pieces squeeze against and are socketed to the limit posts, and the rear ends of the conductive connecting pieces are placed in the receiving grooves.

The chip holder includes: a plurality of supporting platforms, a plurality of limit blocks, a plurality of baffles and a plurality of slots, symmetrically provided at both ends of the chip holder; the chip includes: terminals on a front side, notches, and protrusions at left and right ends; each of the conductive connecting pieces includes: a front-end bending protrusion, a central hole and a rear-end contact part; where two limit blocks in the front of the chip holder match and are caught by the notches of the chip, the baffles at three sides of the rear stand against the chip to restrict the chip from moving left and right, the protrusions at the left and right ends of the chip are engaged with the slots in the chip holder, the rear-end contact parts of the conductive connecting pieces are provided in the receiving grooves, the central I-shaped holes of the conductive connecting pieces are socketed to the limit posts one by one, and the front-end bending protrusions of the conductive connecting pieces abut joint with the chip terminals one by one, and press the chip downward to restrict the chip from moving up and down.

The developing cartridge further includes: a chip holder, where the chip holder is provided on the stepped surface of the cartridge body, and the conductive connecting pieces and the chip are installed and fixed in the chip holder.

The chip holder includes a pair of supporting platforms, two rows of limit posts, an elastic fixing buckle and an elastic limit buckle; each of the conductive connecting pieces includes: a front-end limit hole, a central protrusion and a back-end arch-shaped contact surface, where the limit hole faces a corresponding limit post of the chip holder and is socketed thereto, the supporting platforms support the chip and restrict the chip from moving forward and backward, and the chip terminals are in contact with the central protrusions on the conductive connecting pieces.

The chip further includes: two stepped ends that are provided at both ends of the reverse side of each of the chip terminals, where one end of each of the stepped ends is inserted into the elastic fixing buckle, and the other end thereof is pressed into a corresponding elastic limit buckle.

The developing cartridge further includes a chip holder, where the chip holder is provided on the back surface of the cartridge body, and the chip is installed and fixed in the chip holder.

The chip is provided with a notch, each of the conductive connecting piece is provided with a circular I-shaped hole and a back-end contact surface, at a position corresponding to the chip holder, the upper stepped surface of the cartridge body is provided with a plurality of limit posts matching the number of the chip terminals, and elastic limit buckles arranged in a row, spring holes and a screw hole which run through the upper stepped surface and the lower stepped surface of the cartridge body are provided, the terminals on the front side of the chip face the spring holes and are provided in the chip holder, the chip is fixed in the chip holder by a screw passing through the screw hole, the spring passes through the spring hole with one end of the spring standing against the chip terminal, and the other ends standing against the back-end contact surface of the conductive connecting piece, the circular I-shaped hole of each of the conductive connecting pieces is socketed to a corresponding limit post, and the back-end contact surface of each of the conductive connecting pieces is pressed into a corresponding elastic limit buckle.

Each of the conductive connecting pieces includes: a front-end limit hole, an elastic sheet stamped in the middle and a back-end arch-shaped contact surface; at a position corresponding to the chip holder, the upper stepped surface of the cartridge body is provided with a press bar and limit buckles arranged in a row, through holes and a screw hole which run through the upper stepped surface and the lower stepped surface of the cartridge body are provided, the press bar locates at front ends of the conductive connecting pieces, a plurality of limit posts matching the number of the chip terminals is provided at the back of the press bar, the front ends of the conductive connecting pieces are inserted into the back of the press bar, the limit holes on the conductive connecting pieces are pressed and socketed to the limit posts of the press bar in turn, the limit posts and the conductive connecting pieces are in a hot-melt fixed connection, the elastic sheets pass through the through holes to stand against the chip terminals so as to achieve electrical connections between and the conductive connecting pieces and the chip.

The chip further includes: stepped ends provided at both ends of the reverse side of the chip terminals, and the chip holder further includes a supporting platform, where a stepped end at one end of the chip is inserted into the supporting platform, a stepped end at the other end is fixed in the chip holder by a screw passing through the screw hole.

The developing cartridge further includes a push bar which may stand against the end surfaces of the chip contact heads of the printer and impose a backward push force on the chip contact heads of the printer.

After the described technical solutions are used, since the conductive connecting pieces are provided on the upper surface (upper stepped surface) or the back surface (lower stepped surface) of the cartridge body, the side surfaces of the chip contact heads on the cover of the printer press the developing cartridge upward or downward when coming into contact with the conductive connecting pieces, which prevents the developing cartridge from vibrating up and down during use, thereby solving the technical problem that an existing developing cartridge may easily vibrate up and down during its use and there will be poor contacts between chip terminals and end surfaces of chip contact heads on a cover.

BRIEF DESCRIPTION OF DRAWINGS

FIG. 12 is a locally exploded view of the developing cartridge according to

Figure 13:
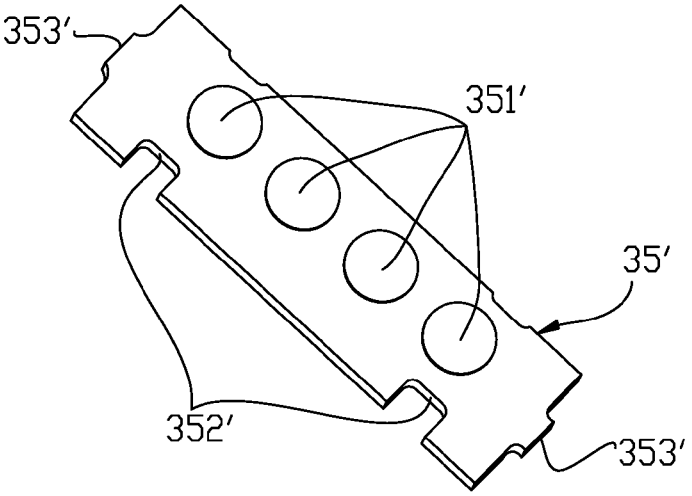
Figure 14:
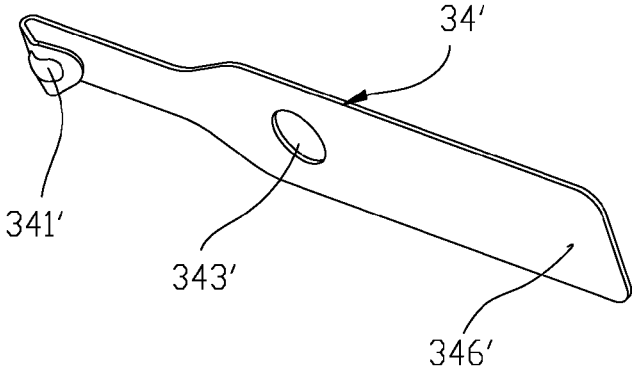
Figure 15:
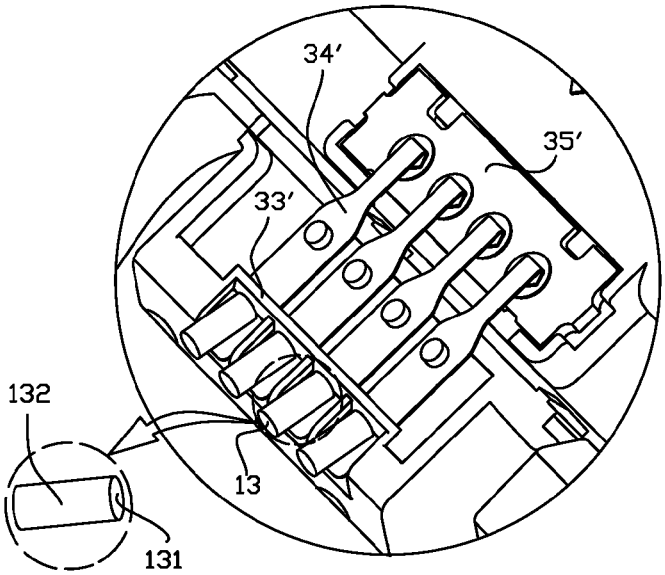
Figure 16:
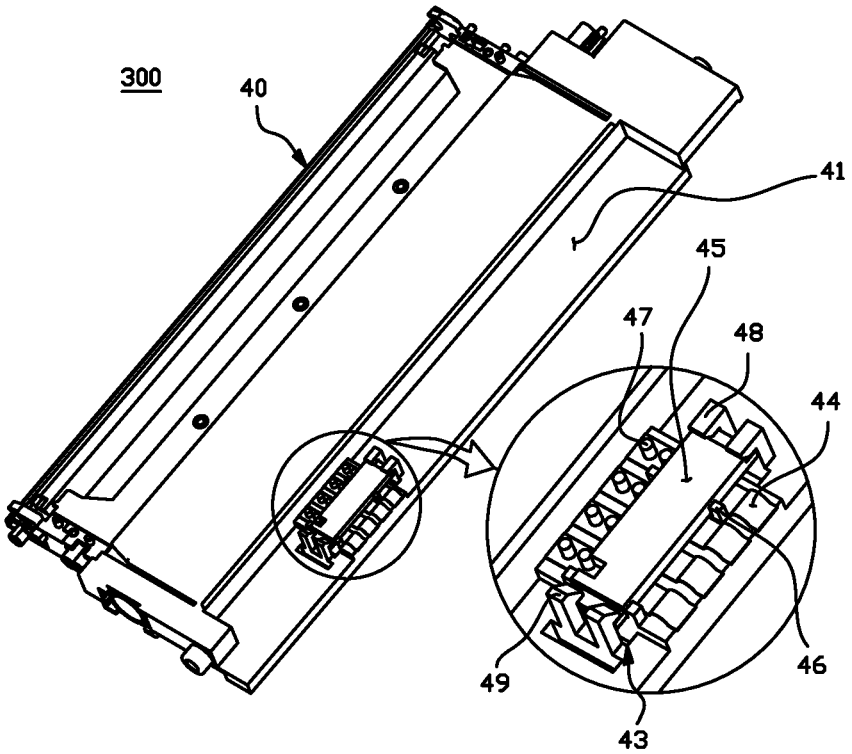
Figure 17:
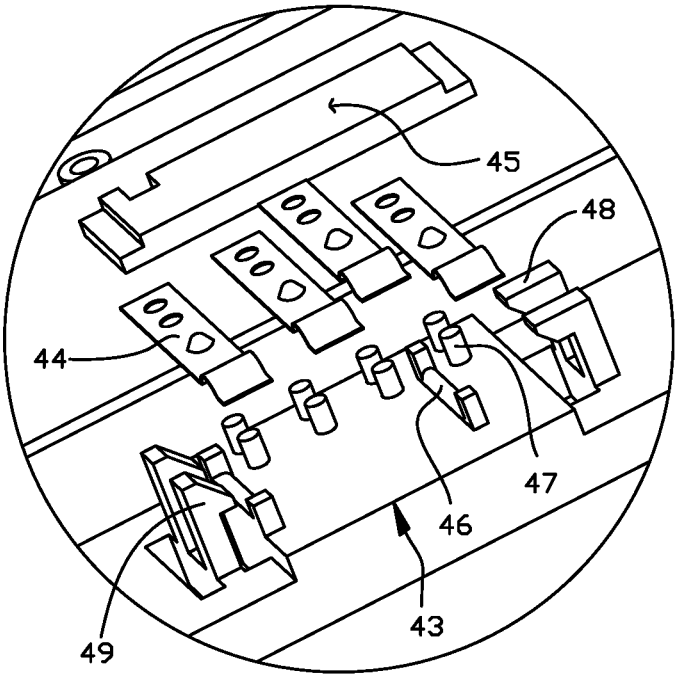
Figure 18:
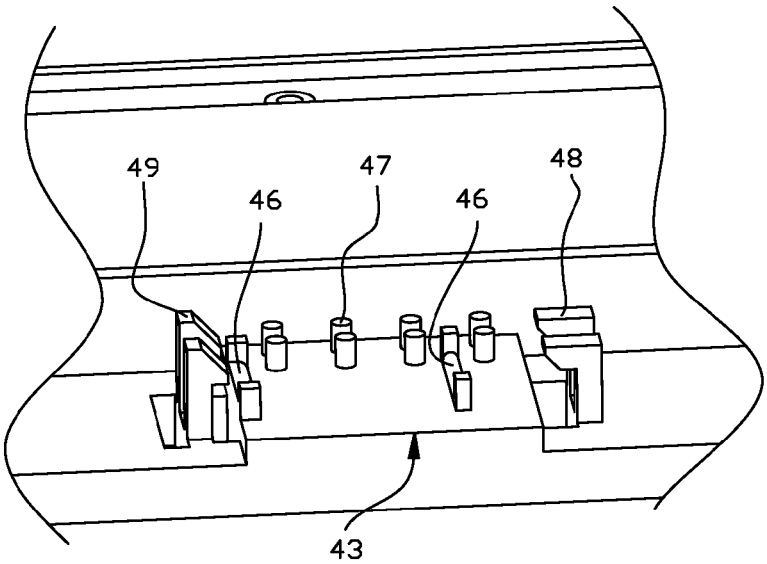
Figure 19:
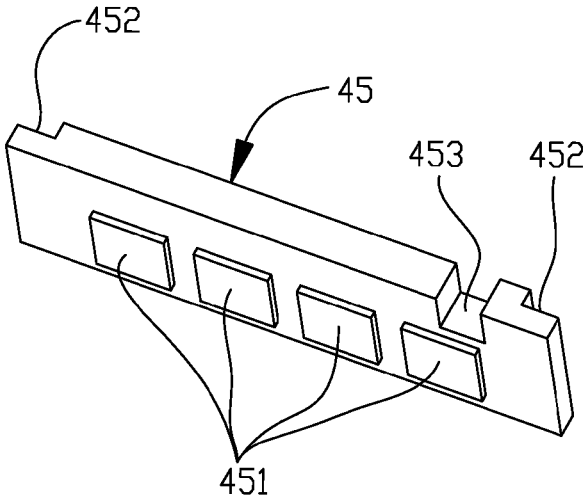
Figure 20:
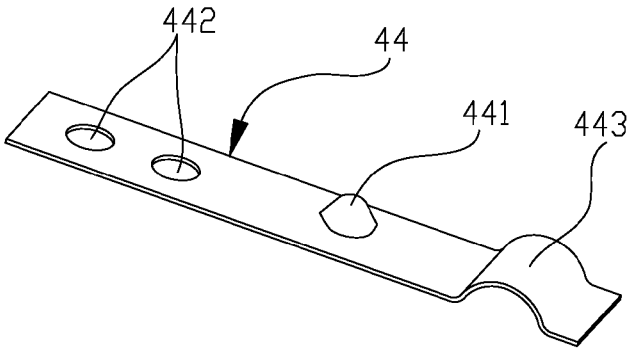
Figure 21:
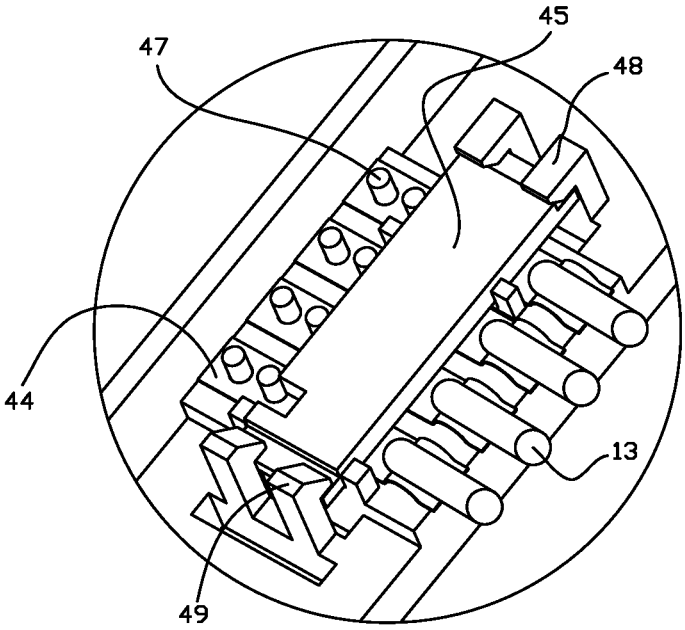
Figure 22:
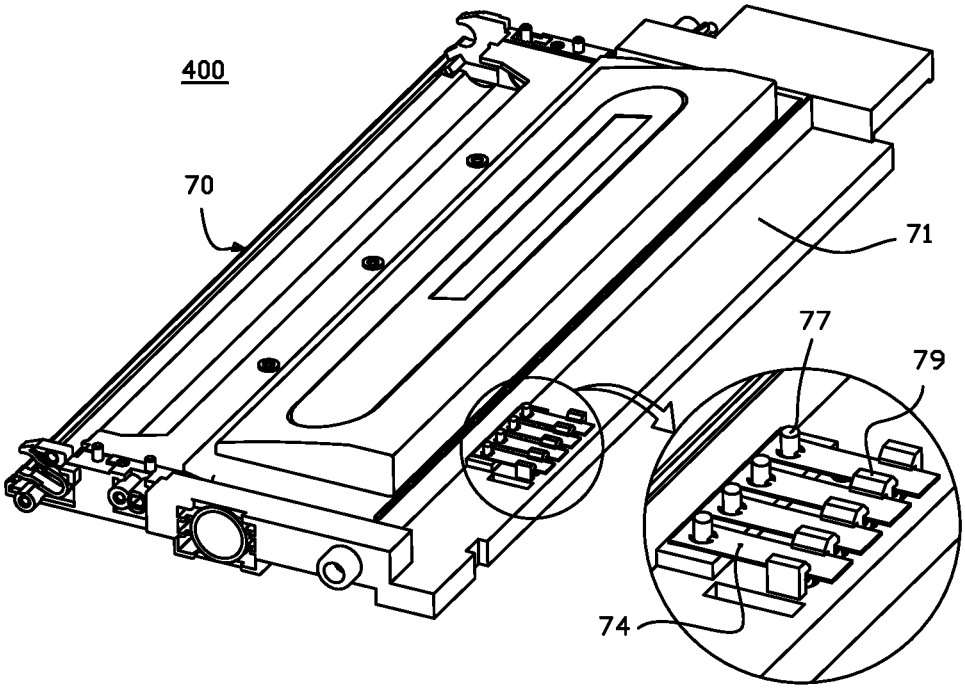
Figure 23:
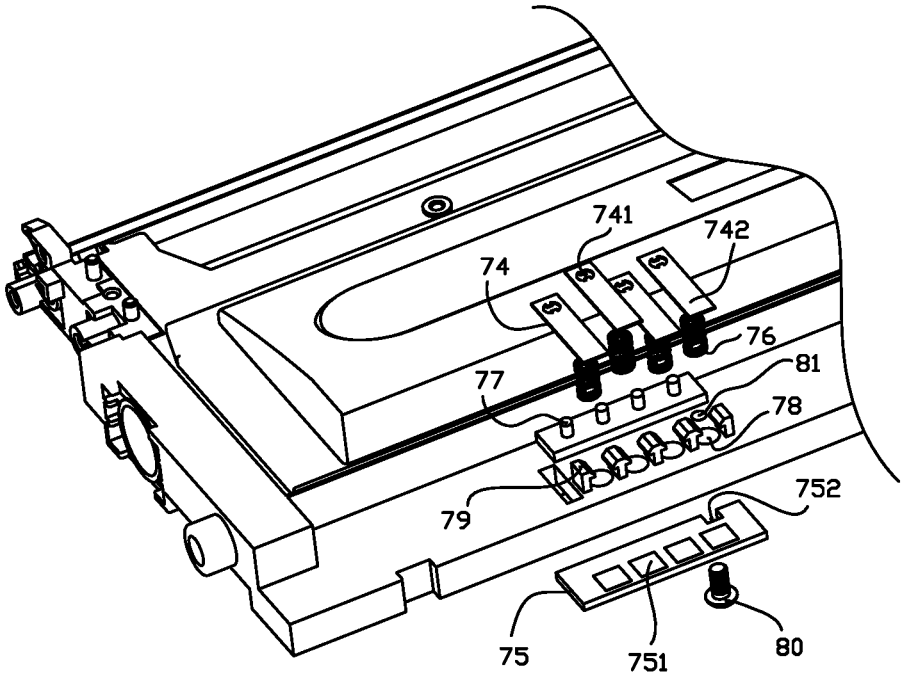
Figure 24:
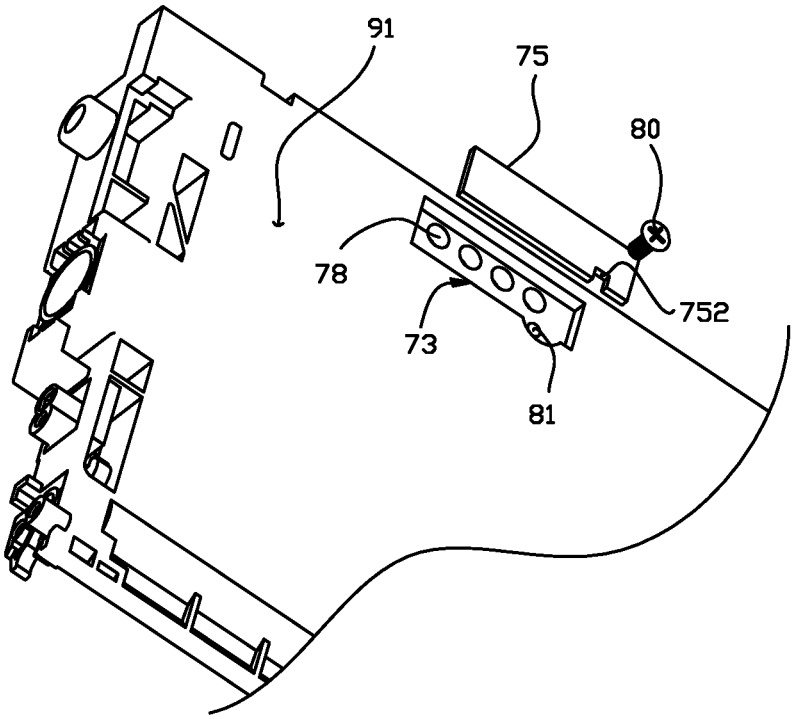
Figure 25:
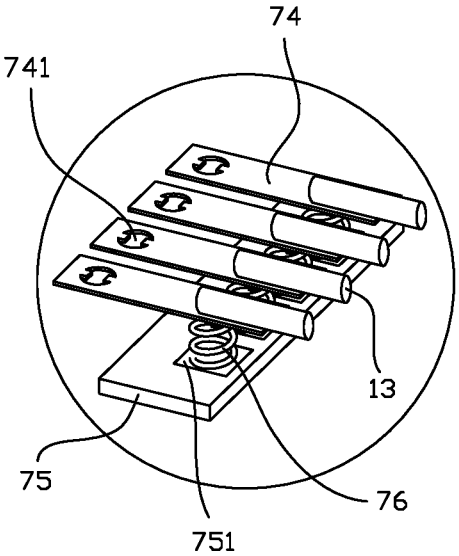
Figure 26:
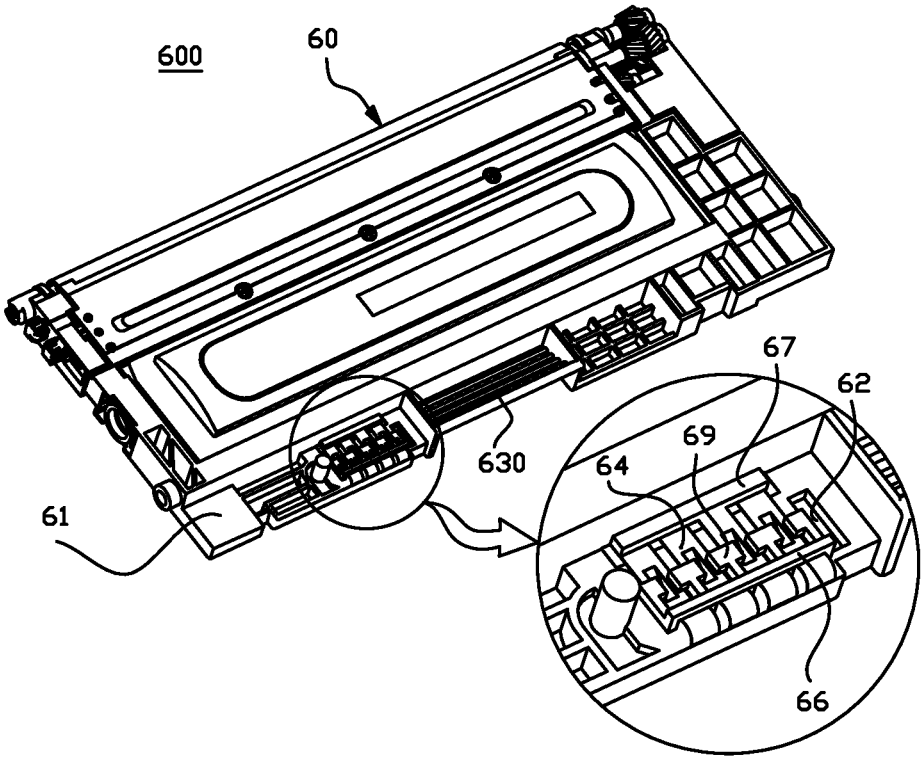
Figure 27:
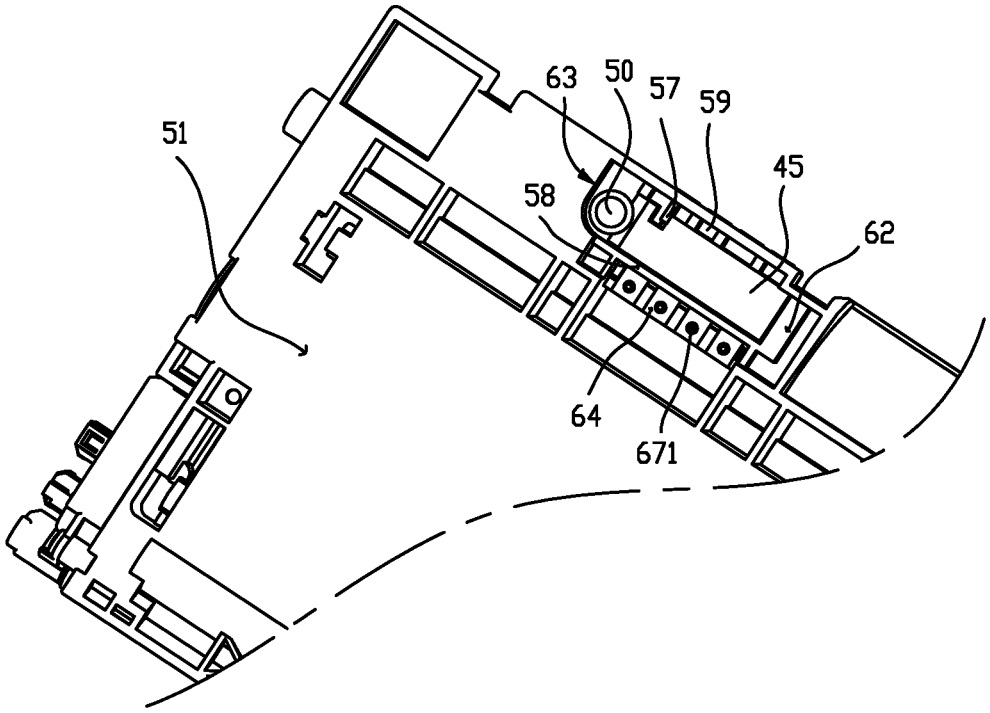
Figure 28:
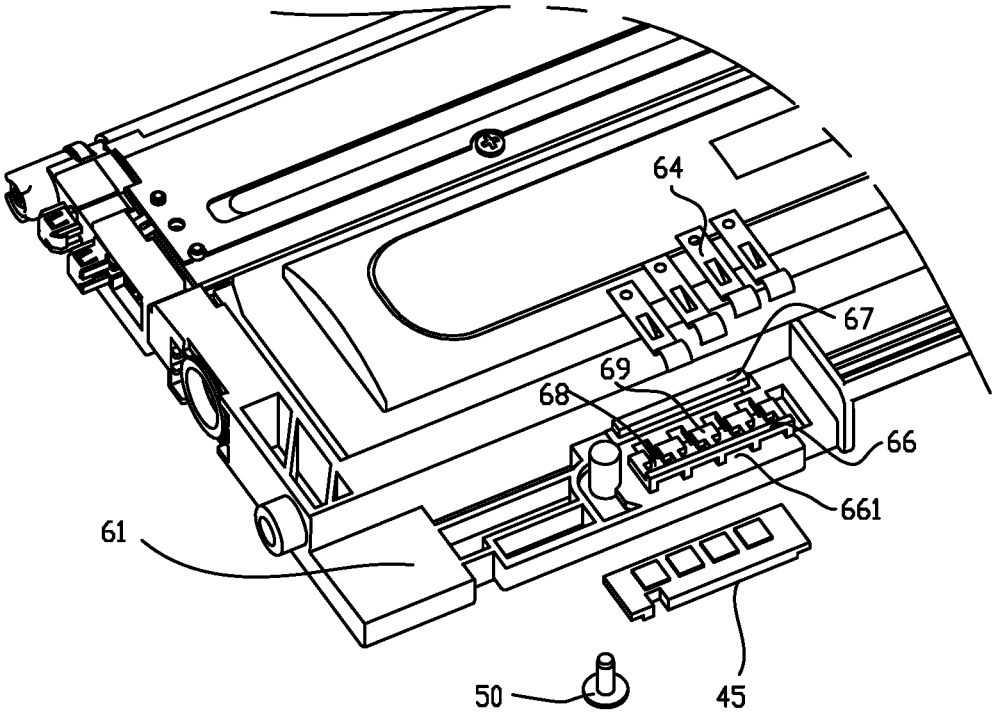
Figure 29:
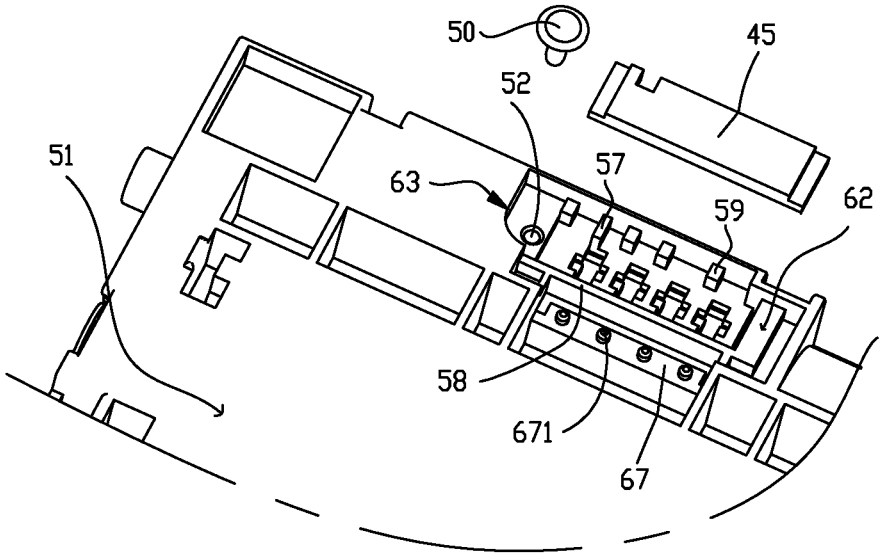
Figure 30:
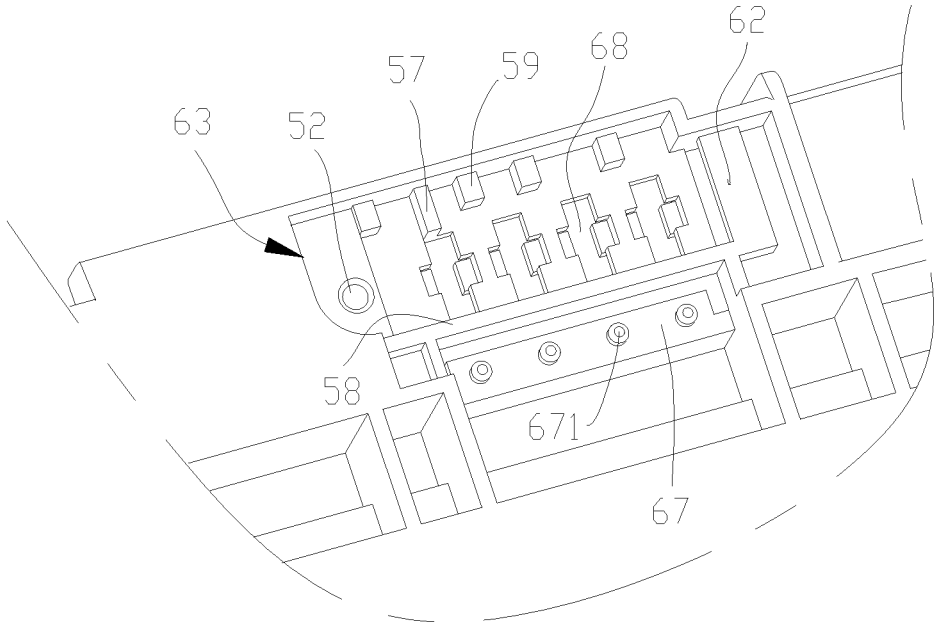
Figure 31:
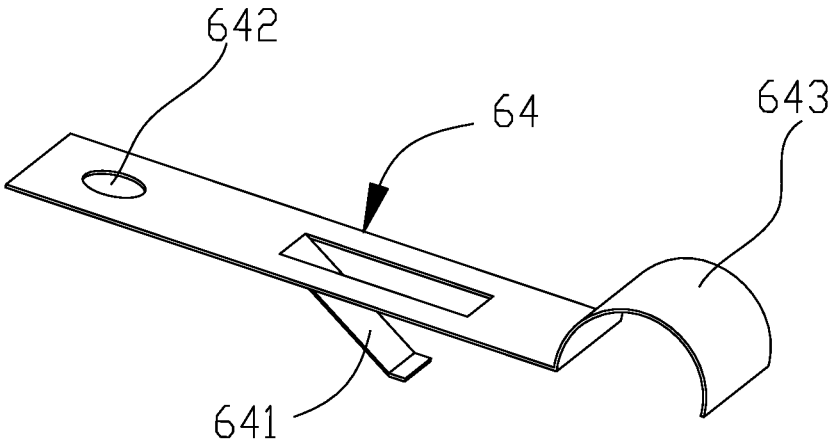
Figure 32:
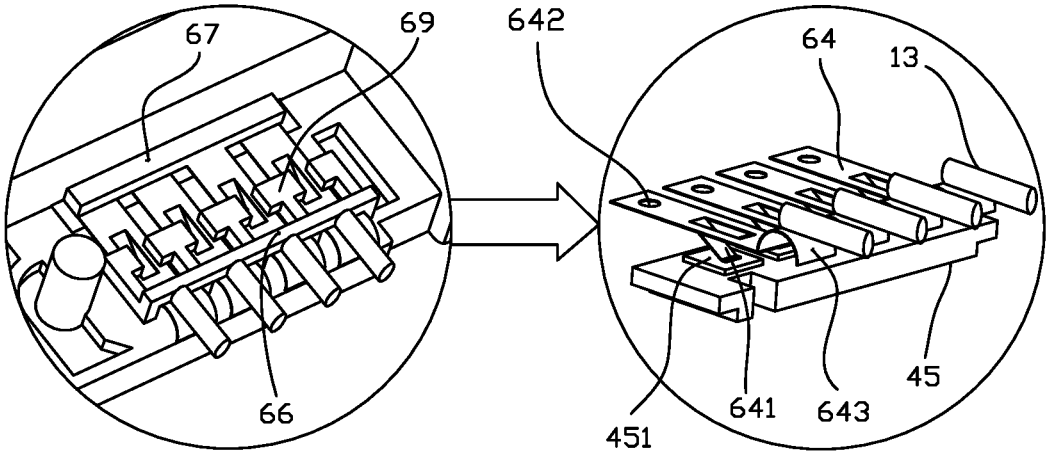
Figure 33:
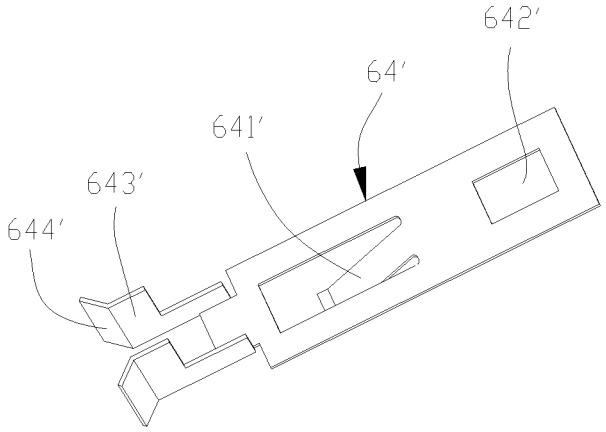
Figure 34:
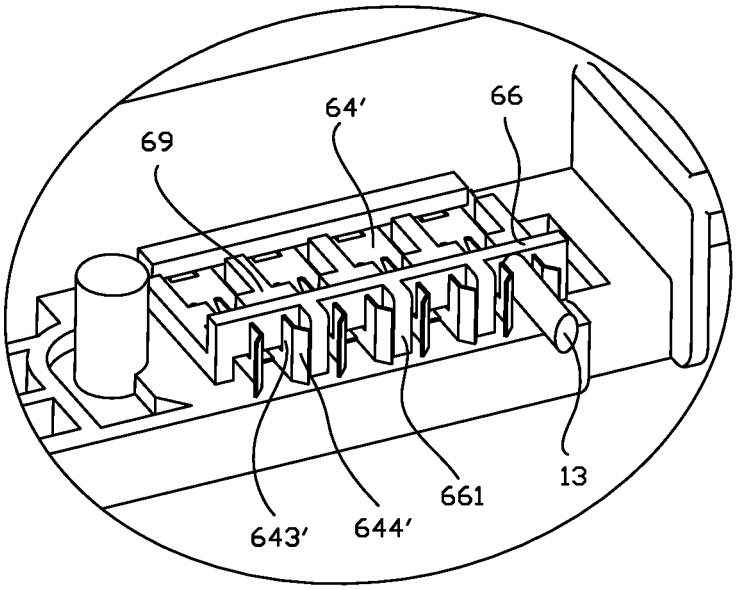
Figure 35:
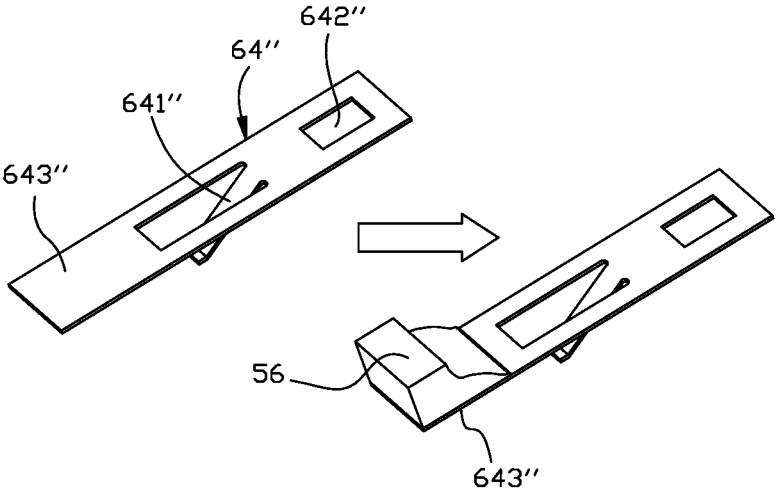
Figure 36:
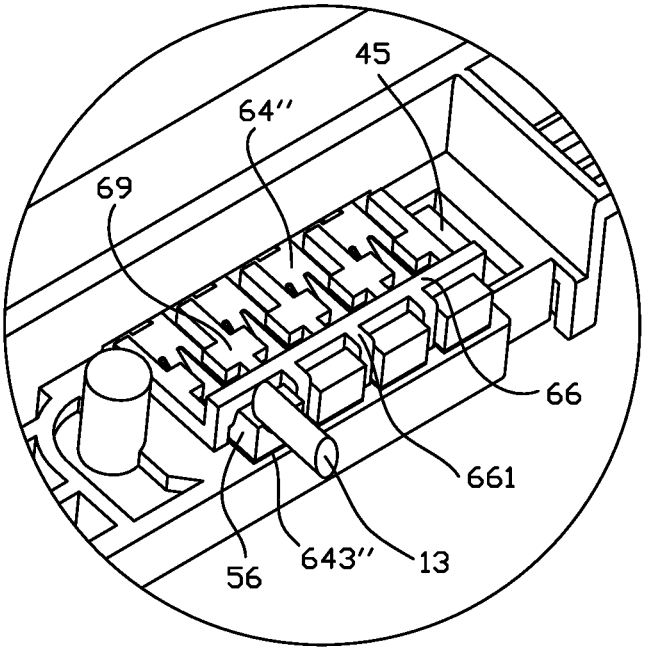
Figure 37:
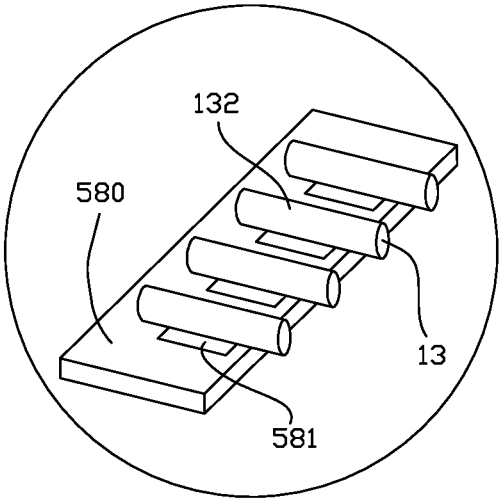
Figure 38:
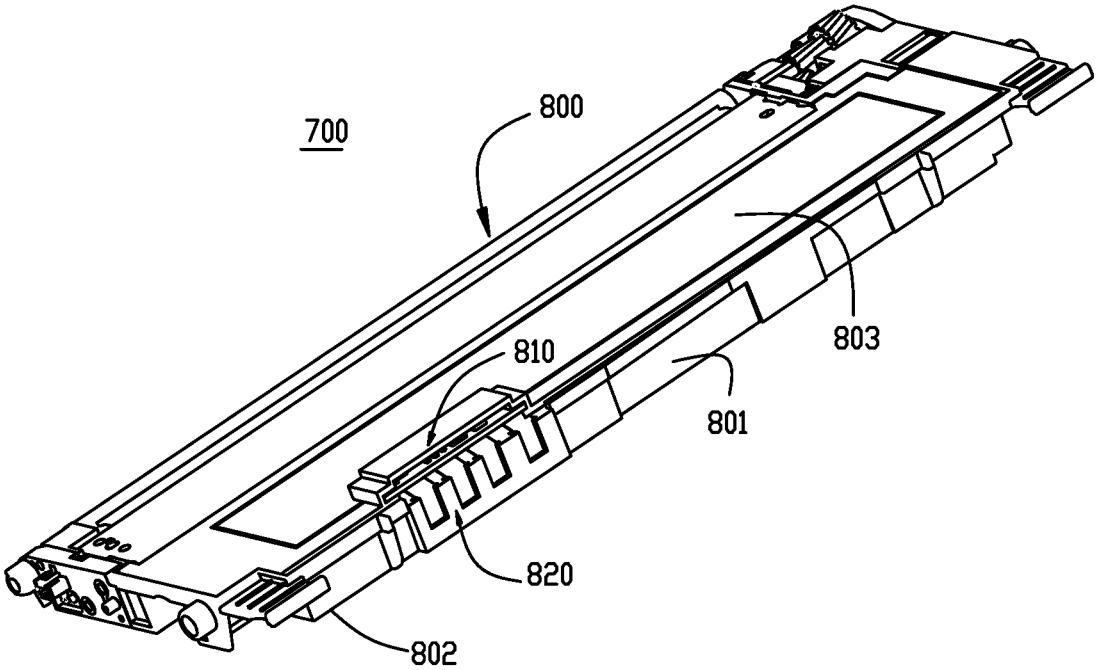
Figure 39:
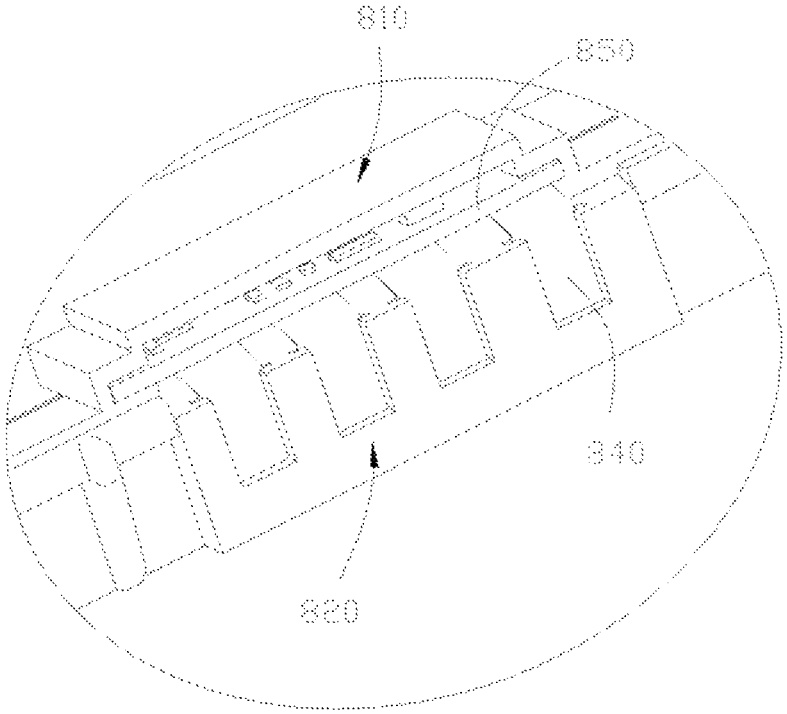
Figure 40:
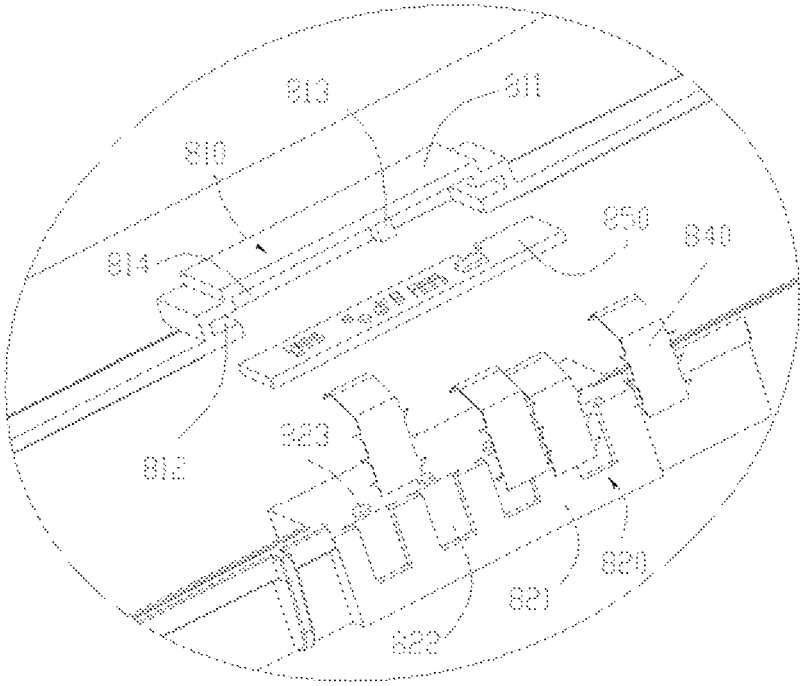
Figure 41A:
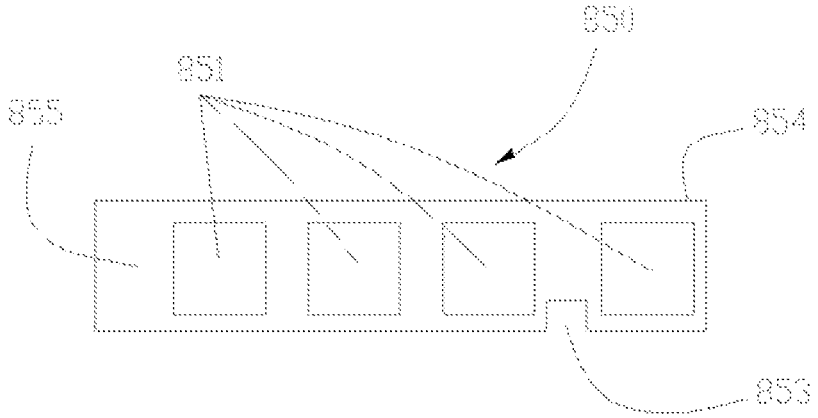
Figure 41B:
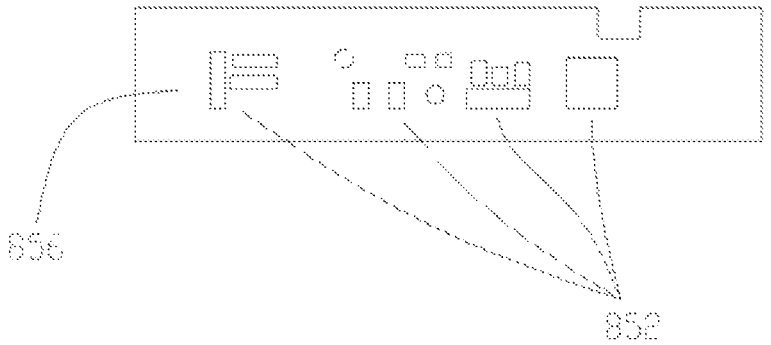
Figure 42:
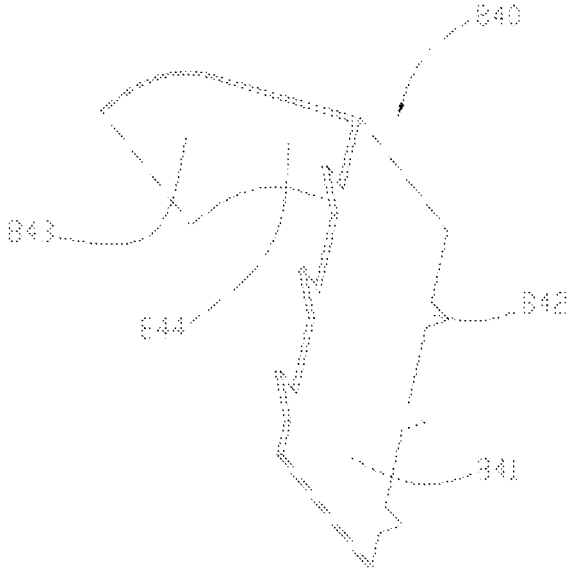

Embodiment 1 of the present invention;

FIG. 13 is a perspective structural view of the chip according to Embodiment 1 of the present invention;

FIG. 14 is a perspective structural view of a conductive connecting piece according to Embodiment 1 of the present invention;

FIG. 15 is a view where conductive connecting pieces come into contact with side surfaces of chip contact heads of a laser printer with a chip being connected to an upper surface of the cartridge body of the developing cartridge according to Embodiment 1 of the present invention;

FIG. 16 is a perspective view of a developing cartridge and a locally enlarged view of the developing cartridge according to Embodiment 2 of the present invention;

FIG. 17 is a locally exploded view of the developing cartridge according to Embodiment 2 of the present invention;

FIG. 18 is a structural view of a chip holder on the upper stepped surface of the cartridge body of the developing cartridge according to Embodiment 2 of the present invention;

FIG. 19 is a perspective structural view of the chip according to Embodiment 2 of the present invention;

FIG. 20 is a perspective structural view of a conductive connecting piece according to Embodiment 2 of the present invention;

FIG. 21 is a view where conductive connecting pieces come into contact with side surfaces of chip contact heads of a laser printer with a chip being to the upper stepped surface of the cartridge body of the developing cartridge according to Embodiment 2 of the present invention;

FIG. 22 is a perspective view of a developing cartridge and a locally enlarged view of the developing cartridge according to Embodiment 3 of the present invention;

FIG. 23 is a locally exploded view of the developing cartridge according to Embodiment 3 of the present invention;

FIG. 24 is a locally exploded view of a chip holder on a back surface of a cartridge body of the developing cartridge according to Embodiment 3 of the present invention;

FIG. 25 is a view of a connection relation among conductive connecting pieces, springs, a chip and chip contact heads of a laser printer according to Embodiment 3 of the present invention;

FIG. 26 is a perspective view of a developing cartridge and a locally enlarged view of the developing cartridge according to Embodiment 3 of the present invention;

FIG. 27 is a local view of a reverse side (back surface) of the developing cartridge according to Embodiment 3 of the present invention;

FIG. 28 is a locally exploded view of a front side (upper surface) of the developing cartridge according to Embodiment 3 of the present invention;

FIG. 29 is a locally exploded view of a reverse side (back surface) of a developing cartridge according to Embodiment 3 of the present invention;

FIG. 30 is a structural view of a chip holder on a back surface of the cartridge body of the developing cartridge according to Embodiment 3 of the present invention;

FIG. 31 is a perspective structural view of conductive connecting pieces according to Embodiment 3 of the present invention;

FIG. 32 is a view and a structural view where conductive connecting pieces on an upper stepped surface of the cartridge body of the developing cartridge come into contact with side surfaces of chip contact heads of a laser printer by connecting elastic sheets stamped in the middle of the conducting connecting pieces with the chip on a back surface of the cartridge body of the developing cartridge according to Embodiment 3 of the present invention;

FIG. 33 is a perspective structural view of a conductive connecting piece according to Embodiment 4 of the present invention;

FIG. 34 is a view where electrical connections are formed by means of side surfaces of chip contact heads on a cover of a laser printer being caught between contact surfaces bending upward and extending from back ends of conductive connecting pieces according to Embodiment 4 of the present invention;

FIG. 35 is a perspective structural view of a conductive connecting piece and a conductive elastic sponge being adhere to a back end of the conductive connecting piece according to an embodiment of the present invention;

FIG. 36 is a view where side surfaces of chip contact heads on a cover of a laser printer come into contact with conductive connecting pieces which are adhered with conductive elastic sponges at back ends according to an embodiment of the present invention;

FIG. 37 is a view where side surfaces of chip contact heads on a cover of a laser printer come into contact with terminals on a front surface of a chip according to an embodiment of the present invention;

FIG. 38 is a perspective view of a developing cartridge according to Embodiment 5 of the present invention;

FIG. 39 is a locally enlarged view of a chip installing part of the developing cartridge according to Embodiment 5 of the present invention;

FIG. 40 is a locally enlarged and exploded view of the chip installing part of the developing cartridge as shown in FIG. 39;

FIG. 41A and FIG. 41B are structural views of the chip according to Embodiment 5 of the present invention;

FIG. 42 is a perspective structural view of the conductive connecting piece according to Embodiment 5 of the present invention.

DESCRIPTION OF EMBODIMENTS

Figure 1:
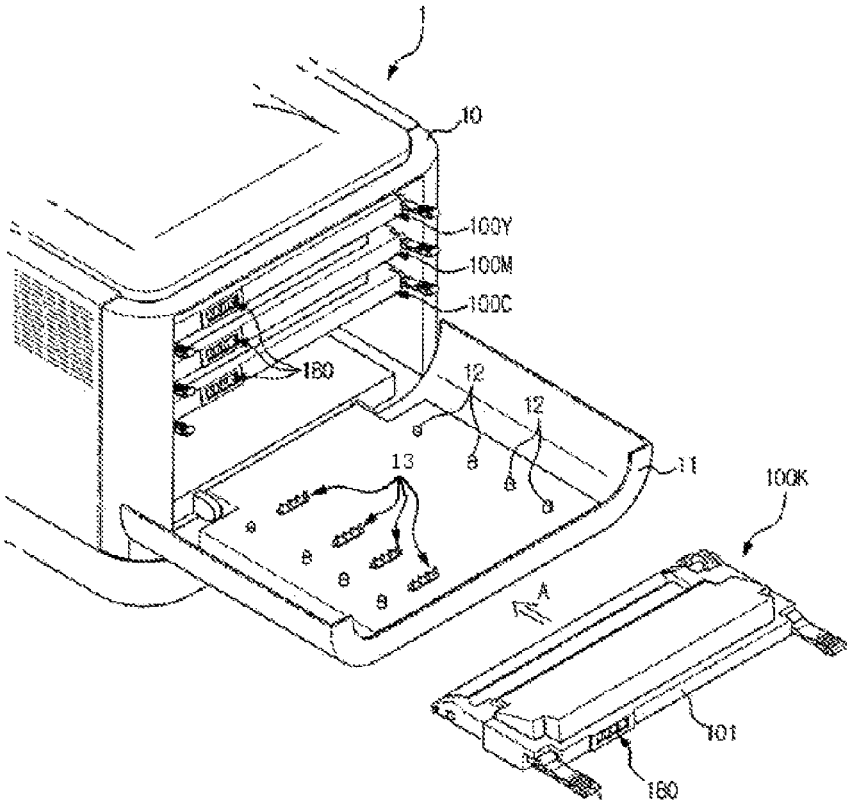
FIG. 1 is a view where a developing cartridge is installed into a laser printer with a chip being provided on a back surface of the developing cartridge in the prior art.
Figure 2:
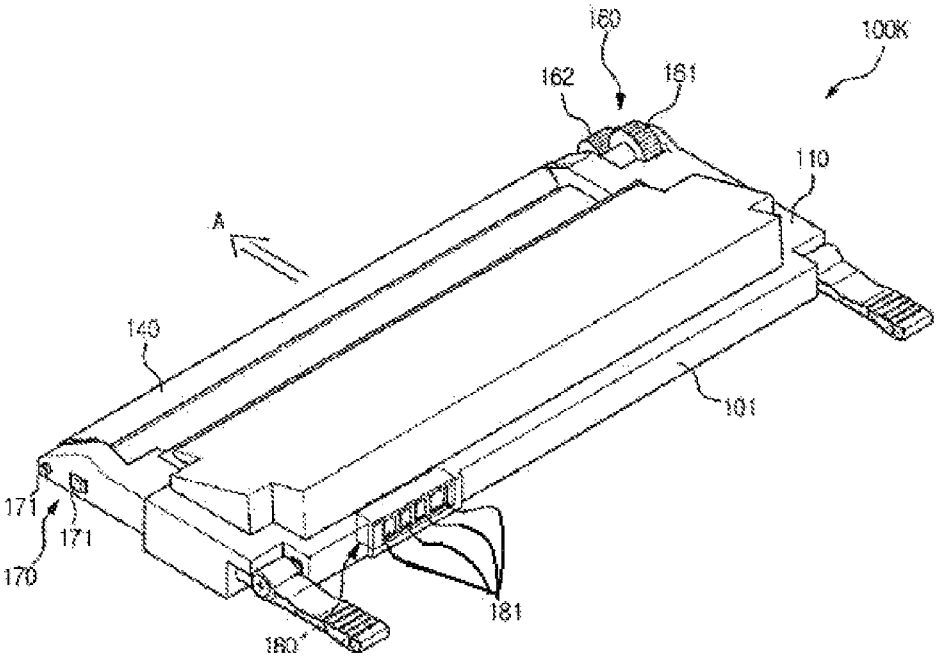
FIG. 2 is a perspective view of a developing cartridge with a chip being provided on a back surface of the developing cartridge in the prior art.
Figure 3:
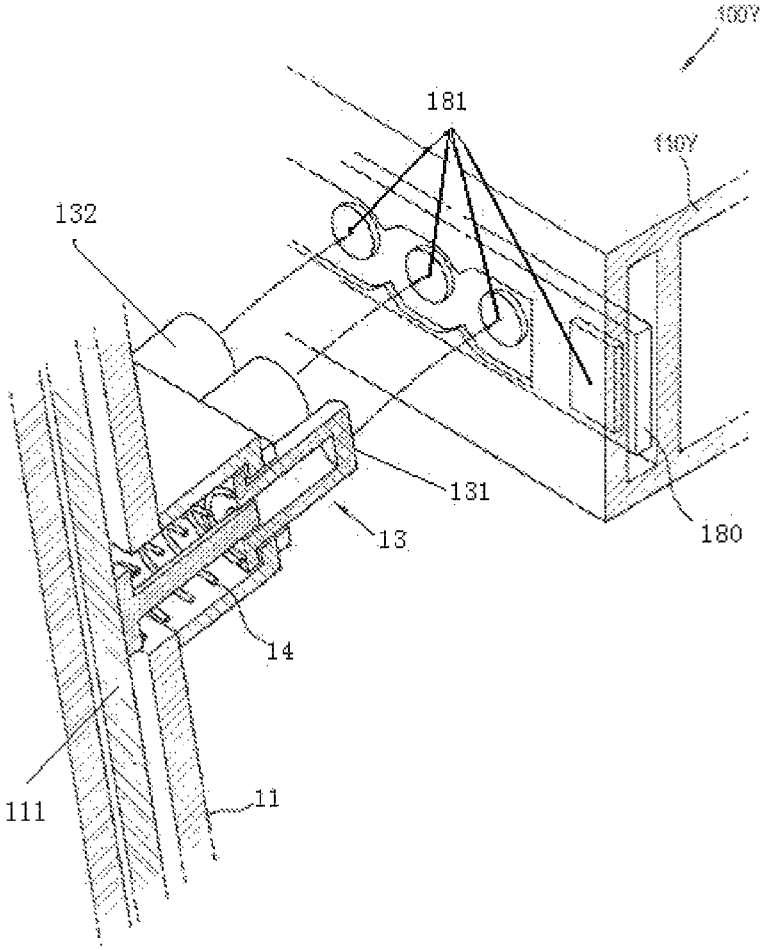
FIG. 3 is a sectional view where a developing cartridge comes into contact with chip contact heads on a cover of a laser printer with a chip being provided on a back surface of the developing cartridge in the prior art.
Figure 4:
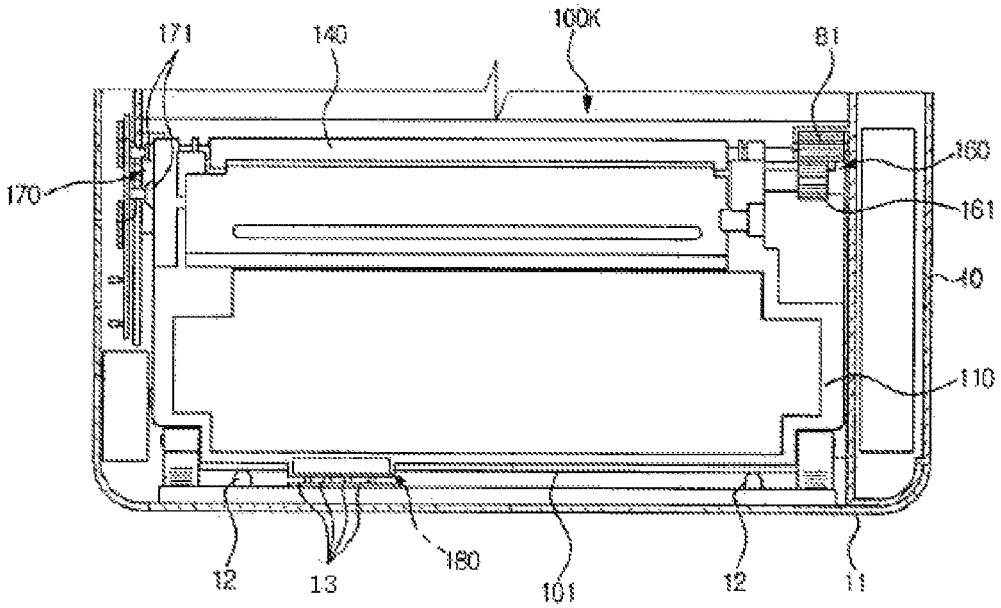
FIG. 4 is a view where elements of a developing cartridge come into contact with and are assembled to a main body of a laser printer when the developing cartridge is installed into the laser printer with a chip being provided on a back surface of the developing cartridge in the prior art.
Figure 5:
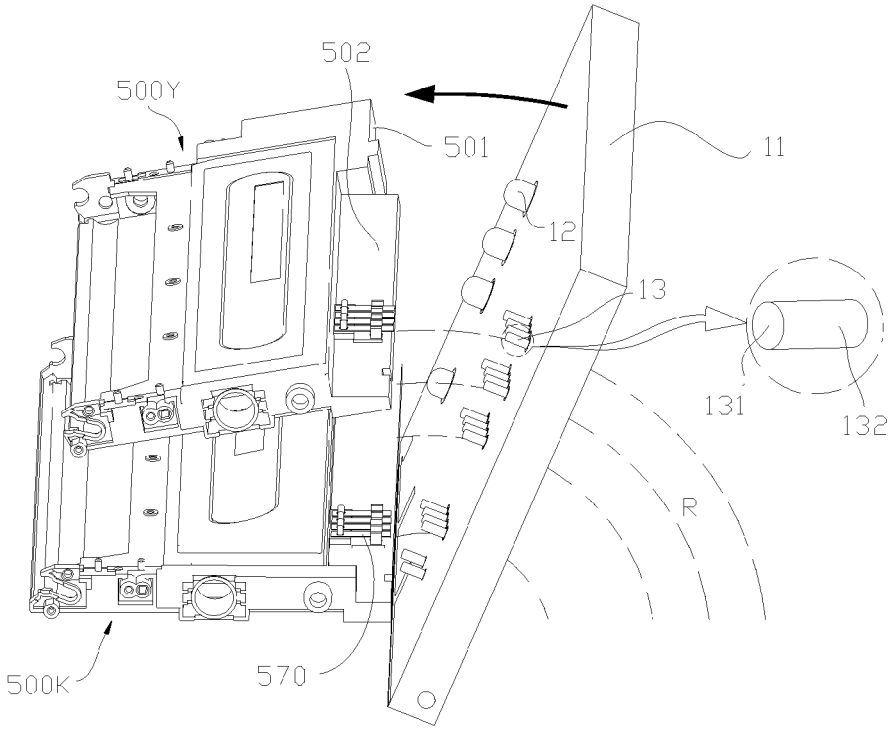
FIG. 5 is a view of a process where a cover of a laser printer is closed when a developing cartridge is installed into a laser printer according to an embodiment of the present invention.
Figure 6:
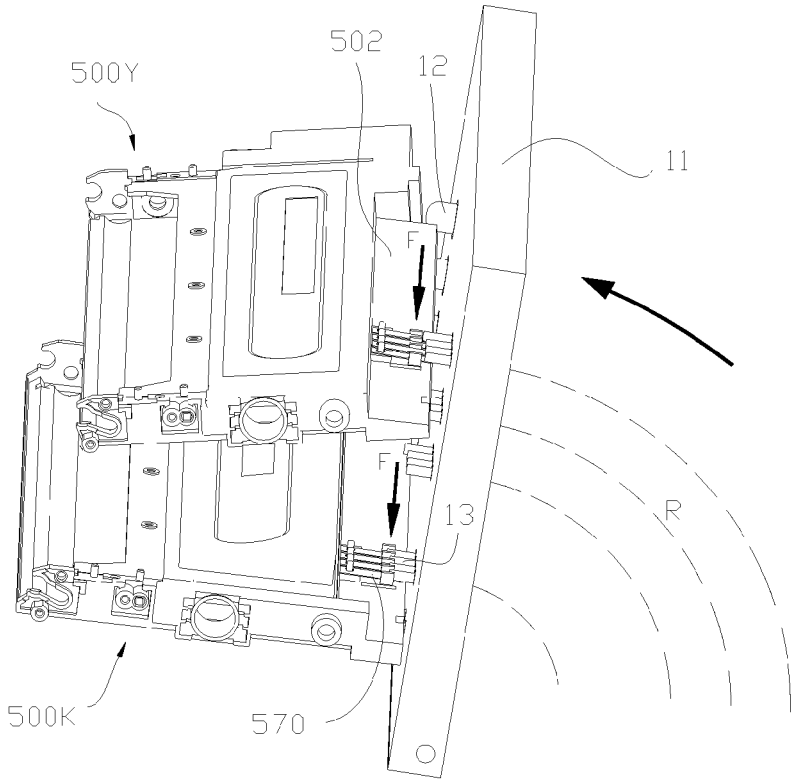
FIG. 6 is a view where side surfaces of chip contact heads on a cover of a laser printer come into contact with conductive connecting pieces on an upper stepped surface of a developing cartridge and press the developing cartridge downward after the developing cartridge is installed into the laser printer and the cover is closed according to an embodiment of the present invention.

In the present invention, the laser printer is the same as that in the background, and except the specially described structure of the developing cartridge, the remaining structures of the developing cartridge are the same as in the background. In order to solve the technical problem as described in the background, the present invention employs a technical solution of: achieving the limit of the developing cartridge in up and down directions by means of a squeezing contact formed between side surfaces of chip contact heads on the cover of the laser printer and an upper surface of a chip on a developing cartridge, and reference may be made to Embodiments 1, 2 and 3 for details. A brief description will be made hereunder on Embodiments 1, 2 and 3 of the present invention. Since chip terminals on the developing cartridge are usually designed into relatively small dimensions, and there is a dynamic contact process between the chip contact heads on the cover of the laser printer and the chip terminals, in order to avoid a poor contact during the two parts coming into contact with each other, the present invention uses conductive connecting pieces with larger areas to be securely connected to the chip terminals, the side surfaces of the chip contact heads on the cover of the laser printer then come into contact with the conductive connecting pieces with larger contact areas, and thus abnormal operation of the developing cartridge due to the poor contact may be reduced efficiently. Reference may be made to FIG. 5-FIG. 6, when a developing cartridge 500 (500K, 500Y) is installed into a main body of a laser printer, during a process of closing a cover 11, chip contact heads 13 on the cover 11, after traveling a circular path R, come into contact with conductive connecting pieces 570 which are connected to a chip that is located on an upper stepped surface 502 of the developing cartridge 500, via side surfaces 132 of the chip contact heads. When the laser printer begins to work, the side surfaces 132 of the chip contact heads 13 on the cover 11 contact, on one hand, with the conductive connecting pieces 570 connected to the chip, to achieve electrical connections, and on the other hand, press the conductive connecting pieces 570 to limit up and down vibrations of the developing cartridge 500; reference may be made to FIG. 6 for a pressed force F. The cover 11 has been designed with corresponding protrusions 12 which may press against the back 501 of the developing cartridge 500 when the cover 11 is closed, this may guarantee that the developing cartridge 500 will not vibrate in forward and backward directions.

Embodiment 1

Figure 7:
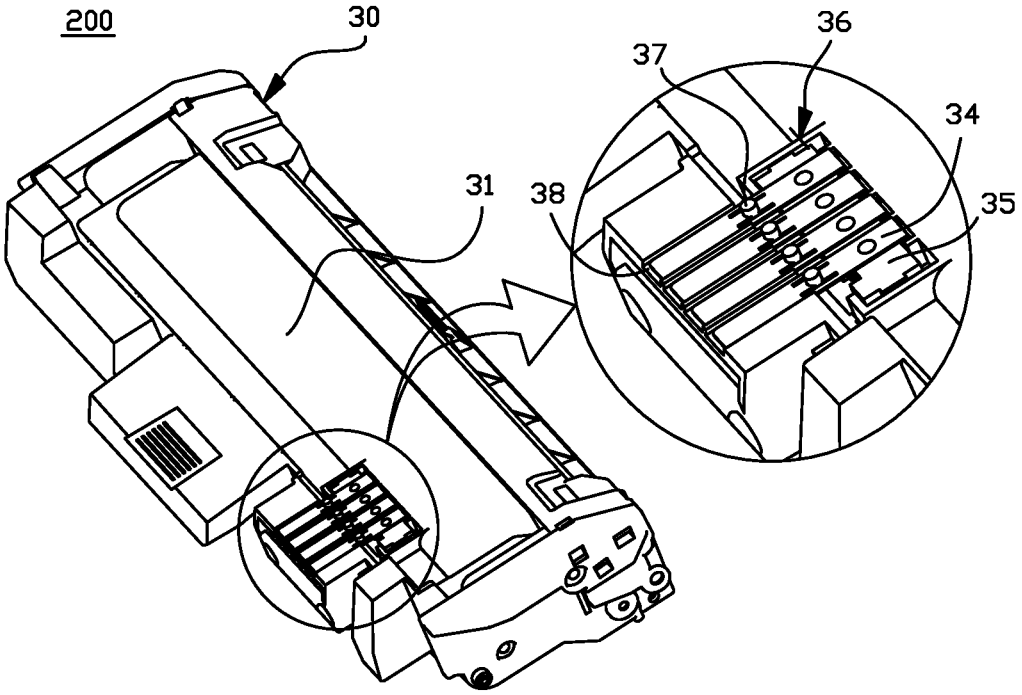
FIG. 7 is a perspective view of a developing cartridge and a locally enlarged view of the developing cartridge according to Embodiment 1 of the present invention.

As shown in FIG. 7, a developing cartridge 200 includes a cartridge body 30, and an upper surface of the cartridge body 30 is provided with a chip holder 36. Conductive connecting pieces 34 and a chip 35 are installed and fixed in the chip holder 36; limit posts 37 and receiving grooves 38 are successively provided on the upper surface 31 of the cartridge body 30 in compliance with rear ends of the conductive connecting pieces 34.

A chip, as used herein, may refer to any semiconductor device having certain functionalities for supporting the cartridge. For example, the chip may be a memory device or memory unit, a microprocessor with on-board memory, or any other appropriate semiconductor device.

Figure 8:
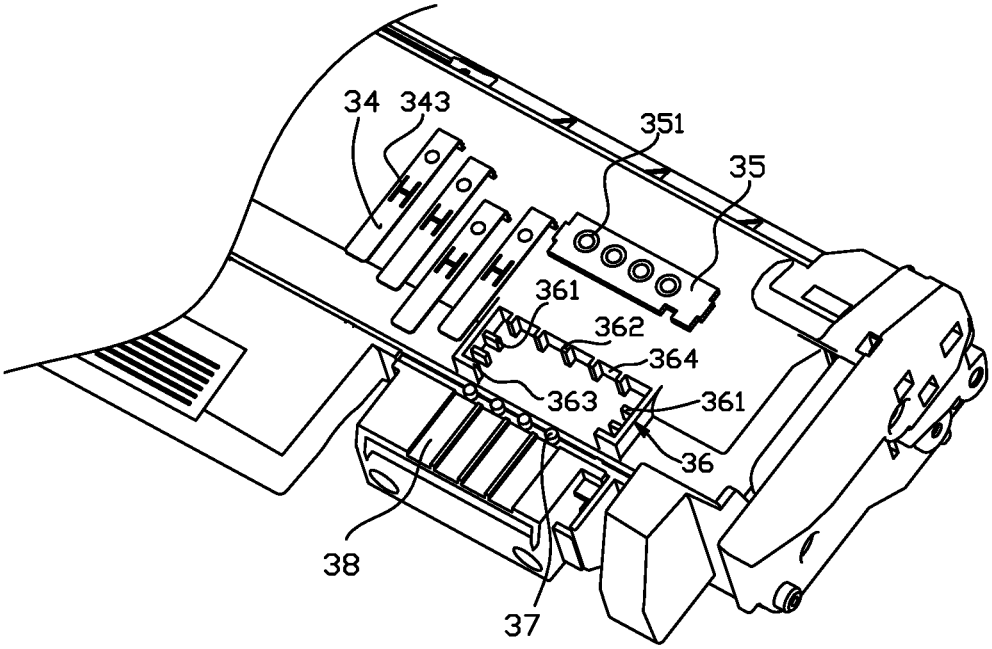
FIG. 8 is a locally exploded view of the developing cartridge according to Embodiment 1 of the present invention.

Reference may be made to FIG. 8 for a locally exploded view of the developing cartridge, where the conductive connecting pieces 34 are provided with I-shaped holes 343 in the middle, and the chip 35 is provided with chip terminals 351. The chip holder 36 includes: a plurality of supporting platforms 361 symmetrically provided at both ends of the chip holder 36, a plurality of limit blocks 362 provided at a side adjacent to the supporting platforms 361, baffles 363, and slots 364 formed between adjacent limit blocks 362; the receiving grooves 38 locate at a rear end of the chip holder 36, and limit posts 37 locate between the chip holder 36 and the receiving grooves 38.

Figure 9A:
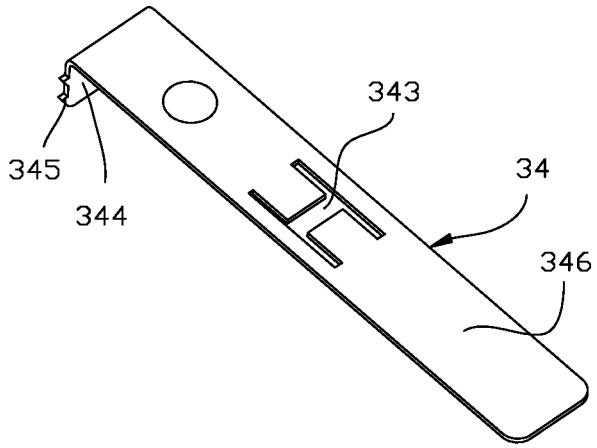
FIG. 9A and FIG. 9B are perspective structural views of conductive connecting pieces according to Embodiment 1 of the present invention.
Figure 9B:
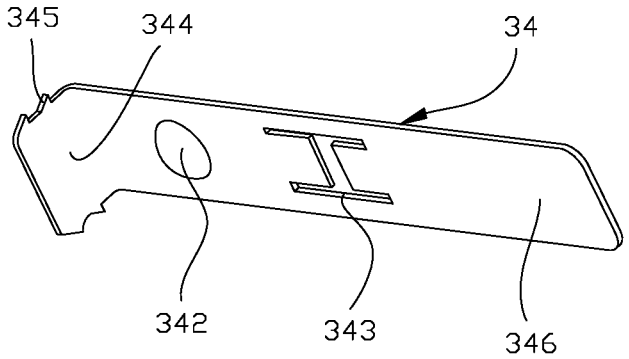

As shown in FIG. 9A and FIG. 9B, the conductive connecting piece 34 includes: a rear end 346, a central I-shaped hole 343, a front-end bend portion 344 and barbed teeth 345 thereon; the conductive connecting piece further includes: a protrusion 342 in contact with the chip terminal, where the protrusion 342 is formed by stamping in a direction where the conductive connecting piece 34 extends towards the front-end bend portion 344.

Figure 10:
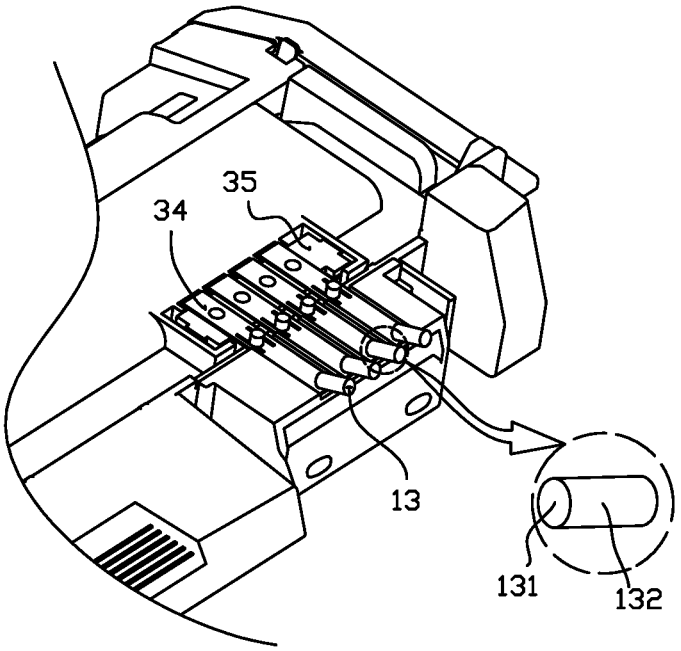
FIG. 10 is a view where conductive connecting pieces come into contact with side surfaces of chip contact heads of a laser printer with a chip being connected to an upper surface of the cartridge body of the developing cartridge according to Embodiment 1 of the present invention.

FIG. 10 is a schematic diagram where the conductive connecting pieces 34 come into contact with the side surfaces 132 of the chip contact heads 13 of the laser printer when being connected to the chip 35.

An assembly process where the conductive connecting pieces 34 come into contact with the chip 35 will be described hereunder in detail.

Reference may be made to FIG. 7, FIG. 8, FIG. 9A, FIG. 9B and FIG. 10, when the terminals 351 of the chip 35 is placed facing up on the supporting platforms 361 in the chip holder 36, the limit blocks 362 in the front of the chip holder 36 and the baffles at three sides of the rear play a role of limiting the chip 35 on all sides, then the conductive connecting pieces 34 are placed across the chip 35 successively so that the front-end bend portions 344 of the conductive connecting pieces 34 are reversely inserted into the slots 334 in the front of the chip holder 36 successively, and since edges of the front-end bend portions 344 of the conductive connecting pieces 34 are carried with the barbed teeth 345, it is difficult for the front-ends of the conductive connecting pieces 34 to loose and out from the slots 364; meanwhile the protrusions 342 formed by stamping on the conductive connecting pieces 34 are abutting joint with the chip terminals 351 one by one, the I-shaped holes 343 in the middle of the conductive connecting pieces 34 squeeze against and are socketed to the limit posts 37, and the rear ends 346 of the conductive connecting pieces 34 are placed in the receiving grooves 38, and then the chip 35 is restricted from moving up and down. As such, the assembly process where the conductive connecting pieces 34 come into contact with the chip 35 is finished.

In this embodiment, the following structural changes may also be made to the chip holder, the limit posts and the receiving grooves of the conductive connecting pieces.

Figure 11:
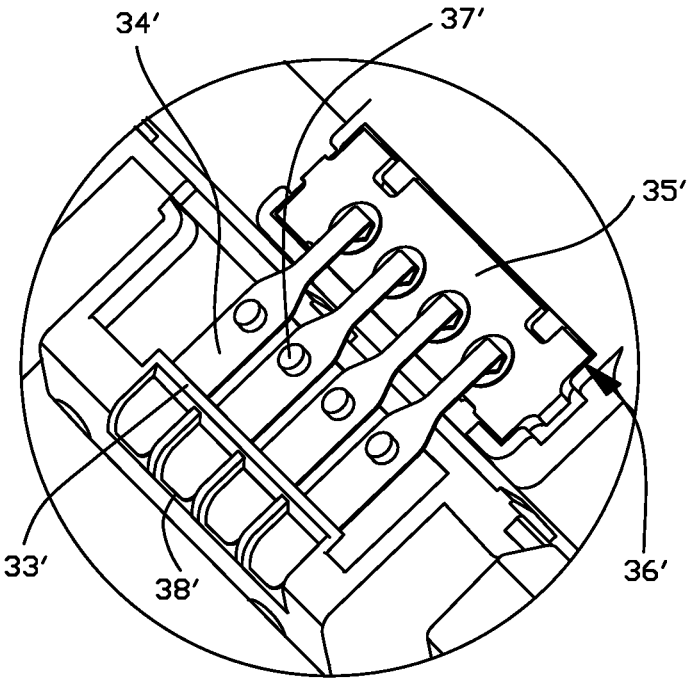
FIG. 11 is a locally enlarged view of the developing cartridge according to Embodiment 1 of the present invention.
Figure 12:
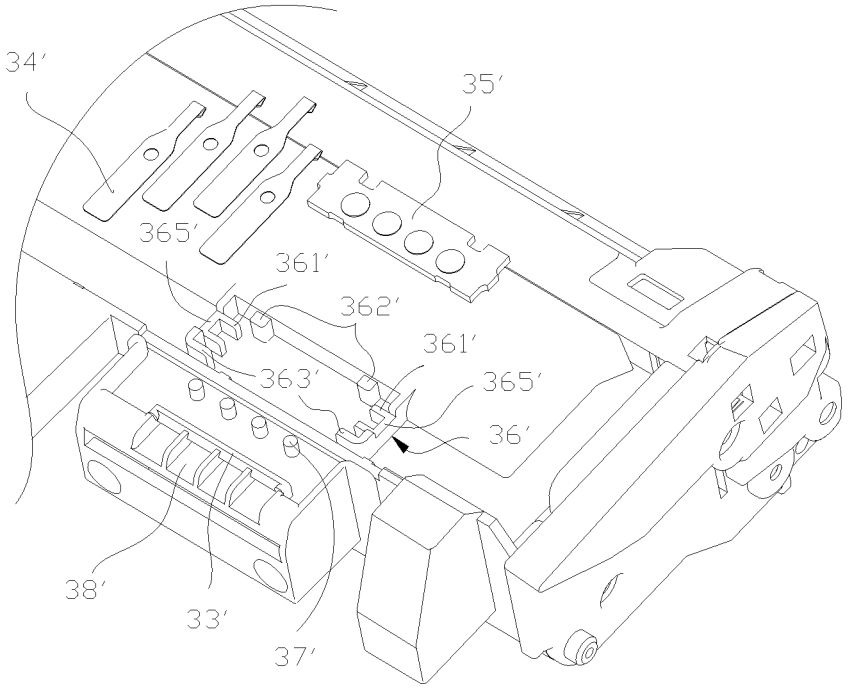

Reference may be made to FIG. 11-FIG. 12, a chip holder 36' includes: a plurality of supporting platforms 361', limit blocks 362', baffles 363' and slots 365', symmetrically provided at both ends of the chip holder 36'.

As shown in FIG. 13, a chip 35' includes: terminals 351' on the front side, notches 352' and protrusions 353' at left and right ends.

As shown in FIG. 14, a conductive connecting piece 34' includes: a front-end bending protrusion 341', a central hole 343' and a rear-end contact part 346'.

An assembly process where the conductive connecting pieces 34' come into contact with the chip 35' will be described hereunder in detail.

Reference may be made to FIG. 11-FIG. 15, when the terminals 351' on a front side of the chip 35' are placed facing up on the chip supporting platforms 361' in the chip holder 36', two limit blocks 362' in the front of the chip holder 36' are just caught in the chip notches 352', the baffles 363' at three sides of the rear play a role of limiting the chip 35' on all sides, and meanwhile the protrusions 353' at left and right ends of the chip fit in with the slots 365' in the chip holder 36', then the rear-end contact parts 346' of the conductive connecting pieces 34' are placed in receiving grooves 38', and then the central holes 343' of the conductive connecting pieces 34' are pressed and socketed to the limit posts 37' in turn, at this time, the front-end bending protrusions 341' of the conductive connecting pieces 34' are abutting joint with the terminals 351' of the chip one by one, and press the chip 35'downward, and thus, the chip 35' is restricted from moving up and down. As such, the assembly process where the conductive connecting pieces 34' come into contact with the chip 35' is finished.

Furthermore, in this embodiment, a push bar 33' may be provided at the ends of the receiving grooves 38' of the conductive connecting pieces. Reference may be made to FIG. 15, when the side surfaces 132 of the chip contact heads 13 of the printer come into contact with the rear-end contact parts 346' of the conductive connecting pieces 34', the end surfaces 131 of the chip contact heads 13 of the printer will press against the push bar 33'. The push bar 33' will impose a backward push force on the chip contact heads 13 of the laser printer to ensure good connections among a circuit board 111, springs 14 and the chip contact heads 13 inside the cover 11.

Embodiment 2

As shown in FIG. 16, a developing cartridge 300 includes a cartridge body 40, and a stepped surface 41 is provided at the back end of the upper surface of the cartridge body 40, where the stepped surface 41 is provided with a chip holder 43, setting the stepped surface may prevent components on the chip holder and elements mounted thereon from being scraped during the process of installing and disassembling the developing cartridge. Conductive connecting pieces 44 and a chip 45 are installed and fixed on the chip holder 43, and the chip holder 43 includes one pair of supporting platforms 46, two rows of limit posts 47, elastic fixing buckles 48 and elastic limit buckles 49.

For position relations of the components on the chip holder 43, reference may be made to a locally exploded view of the developing cartridge as shown in FIG. 17 and a structural diagram of the chip holder 43 as shown in FIG. 18, where the two rows of limit posts 47 mainly function as limiting and fixing the conductive connecting pieces 44, which are provided at a position close to the front of the chip holder 43; the elastic fixing buckles 48 and the elastic limit buckles 49 are provided at both ends of the chip holder 43 respectively; the one pair of supporting platforms 46 mainly function as supporting and limiting the chip 45, and the elastic fixing buckles 48 and the elastic limit buckles 49, which correspond to the one pair of supporting platforms, is provided at a position away from the chip holder 43.

As shown in FIG. 19, the chip 45 includes: terminals 451 on the front side of the chip, stepped ends 452 at both ends of the reverse side of the chip and a notch 453.

As shown in FIG. 20, the conductive connecting piece 44 includes: a front-end limit hole 442, a central protrusion 441 and a back-end arch-shaped contact surface 443.

FIG. 21 is a view of the conductive connecting pieces 44 coming into contact with side surfaces of the chip contact heads 13 of the laser printer when being connected to the chip 45.

An assembly process where the conductive connecting pieces 44 come into contact with the chip 45 will be described hereunder in detail.

Reference may be made to FIG. 16-FIG. 21, the central protrusions 441 and the back-end arch-shaped contact surfaces 443 of the conductive connecting pieces 44 are placed facing up to enable the limit holes 442 on the conductive connecting pieces to face the limit posts 47 of the chip holder 43 and be socketed thereto, the limit posts 47 and the limit holes 442 are in a state of interference fit herein so as to restrict the conductive connecting pieces 44 from moving, then the terminals 451 on the front side of the chip 45 is placed facing down on the supporting platforms 46, the supporting platforms 46 not only may support the chip 45, but also restrict the chip 45 from moving forward and backward, and at this time, the terminals 451 of the chip just come into contact with the protrusions 441 on the conductive connecting pieces 44, meanwhile the stepped end 452 at one end of the reverse side of the chip 45 is inserted into the elastic fixing buckles 48, the stepped end 452 at the other end of the reverse side of the chip 45 is pressed into the elastic limit buckles 49, and thus the chip 45 is limited and restricted on all sides. Then, the assembly process where the conductive connecting pieces 44 come into contact with the chip 45 is finished. When the cover 11 of the laser printer is closed, the end surfaces 131 of the chip contact heads 13 of the printer come into contact with the arch-shaped contact surfaces 443 of the conductive connecting pieces firstly, and then slide towards the front ends of the conductive connecting pieces 44 till the side surfaces 132 of the chip contact heads 13 of the printer and the arch-shaped contact surfaces 443 achieve pressure contacts. Then, electrical connections are achieved among the chip 45, the conductive connecting pieces 44 and the chip contact heads 13 of the printer.

Embodiment 3

As shown in FIG. 22-FIG. 24, a developing cartridge 400 includes a cartridge body 70, where the cartridge body 70 includes an upper stepped surface 71 and a back surface 91. The back surface 91 of the cartridge body 70 is provided with a chip holder 73. A chip 75 is provided with chip terminals 751 and a notch 752; conductive connecting pieces 74 are provided with circular I-shaped holes 741 and back-end contact surfaces 742; and the upper stepped surface 71 of the cartridge body 70 is provided with a plurality of limit posts 77 matching the number of the chip terminals and a plurality of elastic limit buckles 79 arranged in a row. The chip 75 and the conductive connecting pieces 74 are connected via springs 76, the springs 76 are provided in spring holes 78 which run through the upper stepped surface 71 and the back surface 91 of the cartridge body 70; one end of the spring 76 stands against the terminal 751, and the other end of the spring stands against the conductive connecting piece 74. The chip holder 73 is further provided with a screw hole 81, and the chip 75 is fixed in the chip holder 73 via a screw 80.

In order to clearly understand a connection relation among the chip 75, the springs 76, the conductive connecting pieces 74 and the chip contact heads 13 of the printer, the developing cartridge is omitted, as shown in FIG. 25.

An assembly process where the conductive connecting pieces 74 come into contact with the terminals 751 on the chip 75 via the springs 76 will be described hereunder in detail.

Reference may be made to FIG. 22-FIG. 25, firstly, on the back surface 91 of the cartridge body 70, the terminals 751 on the front side of the chip 75 are placed in the chip holder 73 into which the spring holes 78 are provided, and the screw 80 is used to secure the chip 75 after the notch 752 of the chip is aligned with the screw hole 81. Then on the upper stepped surface 71 of the cartridge body 70, the springs 76 are placed in the corresponding spring holes 78 respectively, and then the circular I-shaped holes 741 of the conductive connecting pieces 74 are pressed and socketed to the limit posts 77, meanwhile the back-end contact surfaces 742 of the conductive connecting pieces 74 are pressed into the elastic limit buckles 79, in this case, one end of the spring 76 stands against the terminal 751 of the chip, the other end of the spring stands against the back-end contact surface 742 of the conductive connecting piece 74, and then electrical connections between the conductive connecting pieces 74 and the chip 75 are achieved. Then, the assembly process where the conductive connecting pieces 74 come into contact with the chip 75 via the springs 76 is achieved.

In this embodiment, the conductive connecting pieces may also have a structure as shown in FIG. 31. As shown in FIG. 31, the conductive connecting piece 64 includes: a front-end limit hole 642, an elastic sheet 641 stamped in the middle and a back-end arch-shaped contact surface 643. The front-end limit hole 642 is engaged with the limit post 77, the elastic sheet 641 stands against the terminal 751 of the chip, and then electrical connections between the conductive connecting pieces 64 and the chip 75 are achieved.

The limit posts in this embodiment may also have a replaced structure as follows. As shown in FIG. 26-FIG. 30, at a position corresponding to a chip holder 63 of a back surface 51 of a cartridge body 60, a press bar 67 is provided on an upper stepped surface 61 of the cartridge body 60, where the press bar 67 is located at front ends of the conductive connecting pieces 64; a plurality of limit posts 671 matching the number of the terminals of the chip is provided at the back (that is, facing towards the back surface 51 of the cartridge body 60) of the press bar 67, the front ends of the conductive connecting pieces 64 are inserted into the back of the press bar 67 to enable the limit holes 642 on the conductive connecting pieces 64 to be pressed and socketed to the limit posts 671 of the press bar 67 in turn, here, the limit posts 671 may be hot melted so as to better secure the conductive connecting pieces 64.

In this embodiment, the structure of the chip may be replaced by the structure of the chip 45 as shown in FIG. 19, and the chip holder may be provided with a chip supporting platform, as shown in FIG. 27, FIG. 29 and FIG. 30, a chip supporting platform 62 is provided at the right side of the chip holder 63, which together with a screw 50 support and fix the chip 45.

In this embodiment, a push bar may also be provided, as shown in FIG. 26, FIG. 28 and FIG. 32, a push bar 66 parallel to the press bar 67 is provided close to the back end, and the push bar 66 will impose a backward push force on the end surfaces of the chip contact heads 13 of the laser printer to ensure good connections among a circuit board 111, springs 14 and the chip contact heads 13 inside the cover 11.

In this embodiment, besides replacements or additions, recombinations may also be made for some structures, and an assembly process where the conductive connecting pieces 64 come into contact with the terminals 451 on the chip 45 via the elastic sheets 641 stamped on of the conductive connecting pieces 64 will be described in the below.

Reference may be made to FIG. 26-FIG. 32, firstly, on the upper stepped surface 61 of the cartridge body 60 of a developing cartridge 600, the conductive connecting pieces 64 are successively inserted along slots 661 that are below the push bar 66 so that the elastic sheets 641 which are formed by stamping the middle of the conductive connecting pieces 64 enter into through holes 68 below limit buckles 69 and back ends of the conductive connecting pieces 64 extend to the below of the press bar 67. Then on the back surface 51 of the cartridge body 60, the limit holes 642 at the back ends of the conductive connecting pieces 64 are pressed and socketed to the limit posts 671 of the press bar 67 in turn, here, the limit posts 671 may be hot melted so as to better secure the conductive connecting pieces 64, then the terminals 451 on the front side of the chip 45 face the through holes 68 so that the stepped end 452 at one end of the chip 45 is inserted into the chip supporting platform 62 of the chip holder 63 and the stepped end 452 at the other end is pressed into the chip holder 63 correspondingly, at this time, the terminals 451 on the chip 45 come into contact with the elastic sheets 641 on the conductive connecting pieces 64 which pass through the through holes 68, one by one accordingly, and the chip 45 is just caught between baffles 58 of the chip holder 63 and limit blocks 59 of the chip holder 63 in a length direction of the chip, meanwhile the notch 453 on the chip 45 stands against a catching block 57, in this case, the chip 45 is limited on all sides, finally a screw 50 is threaded into a screw hole 52, the edge of the screw 50 is pressed onto the stepped end 452 at the other end of the chip 45, and thus the chip 45 is limited and restricted in up and down directions. Then, the assembly process where the conductive connecting pieces 64 come into contact with the chip 45 is completed.

In this embodiment, a handle 630 is provided at a position close to the middle of the back end of the cartridge body 60, as shown in FIG. 26. Setting the handle 630 may guarantee the convenience of installing the developing cartridge into the main body of the printer or disassembling it from the main body of the printer.

Embodiment 4

In this embodiment, the same structural features as in Embodiment 3 will not be repeated here; while the difference lies in the manner in which the back ends of the conductive connecting pieces are brought into contact with side surfaces of the chip contact heads on the cover of the printer.

As shown in FIG. 33, a conductive connecting piece 64' includes: a front-end limit hole 642', an elastic sheet 641' stamped in the middle, and a contact surface 643' and a guide surface 644' that bend upward and extend from both sides of the back end respectively, where functions and assembly and contact modes of parts of the conductive connecting piece 64' are the same as those of the conductive connecting piece 64, except the contact surface 643' and the guide surface 644' that bend upward and extend from both sides of the back end of the conductive connecting piece 64', the guide surface 644' extending from an end of the contact surface 643' in a certain degree.

Reference may be made to FIG. 34, when the assembled developing cartridge is installed into the printer and the cover is closed, the chip contact head 13 on the cover of the printer is guided by two guide surfaces 644' at the back end of the conductive connecting piece 64' to enter between two contact surfaces 643', and since the two guide surfaces 644' open towards two sides, they may succeed in guiding the chip contact head 13 along the two contact surfaces 643', and the two contact surfaces 643' squeeze side surface of the chip contact head 13 to some extent and catch the chip contact head 13 between the two contact surface 643', a close-fitted engagements may be achieved between the chip contact head 13 on the cover of the printer and the conductive connecting piece 64', meanwhile a plurality of separators 661 extending from the push bar 66 may prevent the guide surfaces 644' at the back ends of adjacent conductive connecting pieces 64' from contacting with each other.

In this embodiment, a bottom contact surface may be formed by extending between the contact surfaces bending upward and extending from both sides of the back end of the conductive connecting piece, along bottom surface of the back end of the conductive connecting piece. In this case, when the chip contact head on the cover of the printer is brought into contact with the conductive connecting piece, the contact surfaces at both sides of the back end of the conductive connecting piece and the bottom contact surface come into contact with the side surface of the chip contact head simultaneously.

Embodiment 5

As shown in FIG. 38, a developing cartridge 700 includes a cartridge body 800, where an upper surface 803 of the cartridge body 800 is provided with a chip assembly 810, and a back surface 801 of the cartridge body 800 is provided with a conductive connecting piece assembly 820 at a position corresponding to the chip assembly 810.

Reference may be made to FIG. 39-FIG. 40, the chip assembly 810 includes a chip 850 and a chip holder 811, the chip holder 811 is provided with a chip slot 812, a protrusion 813 and a reserved space 814. The conductive connecting piece assembly 820 includes a conductive connecting piece 840 and a holder 821 thereof, the holder 821 is provided with a conductive connecting piece slot 822 and an adhesive locating post 823.

As shown in FIG. 41A and FIG. 41B, the chip 850 includes a substrate 854, terminals 851 disposed on a front side 855 (as shown in FIG. 41A) of the substrate 854 and electronic components 852 disposed on a reverse side 856 (as shown in FIG. 41B) of the substrate 854. There is an open slot 853 on the substrate 854.

As shown in FIG. 42, the conductive connecting piece 840 includes a printer contact part 841 (in contact with the chip contact head 13 on the cover 11 of the laser printer), where the printer contact parts 841 is provided with teeth 842 in the shape of a right angled triangle; the conductive connecting piece 840 also includes a transition area 844 and an elastic contact part 843 (in elastic contact with the terminals 851 of the chip 850), where a plane in which the transition areas 844 is located is perpendicular to a plane in which the printer contact part 841 is located, the elastic contact part 843 is the front part of the transition area 844 and the elastic contact part 843 is an elastic surface bending inwards slightly.

A process where the chip assembly 810 is assembled to the conductive connecting piece assembly 820 will be described hereunder in detail.

Reference may be made to FIG. 39-FIG. 42, when the chip 850 is loaded into the chip slot 812, the protrusion 813 on the chip holder 811 is engaged with the open slot 853 of the chip 850, and at this time, the front side 855 of the chip 850 faces downward, that is to say, the surface disposed with the terminals 851 faces downward; the reverse side 856 of the chip 850 faces upward, that is to say, the surface disposed with the electronic components 852 faces upward; and these protruding electronic components 852 just locate inside the reserved space 814 above the chip slot 812. When the conductive connecting piece 840 is loaded into the conductive connecting piece slot 822, the printer contact part 841 together with the teeth 842 thereon enter into the conductive connecting piece slot 822, and at this time, the adhesive locating post 823 on the holder 821 of the conductive connecting pieces is just brought into contact with and adhere to the transition area 844 of the conductive connecting piece 840. When the chip assembly 810 and the conductive connecting piece assembly 820 are assembled together, that is, when the cartridge body 800 is assembled, the elastic contact part 843 on the conductive connecting piece 840 is in elastic contact with the terminals 851 on the chip 850 correspondingly.

The above chip holder and the holder of the conductive connecting piece may be provided on the cartridge body of the developing cartridge separately, and may also be integrally injection-molded with the cartridge body of the developing cartridge. Moreover, corresponding to the position of the upper surface 803 of the cartridge body 800, the chip assembly 810 may also be provided on a back surface 802 of the cartridge body 800, and then the conductive connecting piece assembly 820 is provided on the upper surface 803 of the cartridge body 800 in compliance with the chip assembly 810.

Communication function between the developing cartridge and the laser printer via the chip can be achieved according to Embodiment 5 of the present invention, and direct contacts between the terminals of the chip and the chip contact heads on the cover of the laser printer are avoided, which will cause those electronic components welded onto the reverse side of the chip to become deformed or misplaced due to the squeeze, thereby solving the problem of chip malfunctioning and even being damaged, which is the problem intended to be solved in the background technology.

Embodiments 1, 2 and 3 of the present invention are based on the optimal and most convenient design solutions without departing from the keystone that the developing cartridge comes into contact with the side surfaces of the chip contact heads of the printer via the conductive connecting pieces on the upper surface or the upper stepped surface of the cartridge body, and structures of the chip holder, the conductive connecting pieces and the chip as described in embodiments of the present invention above may be freely combined according to specific designs.

The developing cartridge which has been installed with the chip, the conductive connecting pieces and other components described in Embodiments 1, 2 and 3 of the present invention above is loaded into the main body of the laser printer, as shown in FIG. 5-FIG. 6, where during the process of closing the cover 11, the chip contact heads 13 on the cover 11, after traveling a circular path R, come into contact, via the side surfaces 132, with the conductive connecting pieces 570 which are connected to the chip and located on the upper stepped surface 502 of the developing cartridge 500, and press the developing cartridge 500 downward. When the laser printer begins to work, the side surfaces 132 of the chip contact heads 13 on the cover 11 contact, on one hand, with the conductive connecting pieces 570 connected to the chip, to achieve electrical connections, and on the other hand, press the conductive connecting pieces 570 to limit up and down vibrations of the developing cartridge 500 between guide gaps; reference may be made to FIG. 6 for a pressed force F. The cover 11 has been designed with corresponding protrusions 12 which may press against the back 501 of the developing cartridge 500 when the cover 11 is closed, this may guarantee that the developing cartridge 500 will not vibrate in front and back directions.

In Embodiments 1, 2 and 3 of the present invention, the number of the conductive connecting pieces is determined according to the number of the memory terminals. Moreover, in order to further ensure reliability of information transmission between the developing cartridge and the laser printer, a conductive elastic material may be adhered at the back ends where the conductive connecting pieces come into contact with the side surfaces of the chip contact heads on the cover of the printer; such material has adhesiveness at the sides that are in contact with the back ends of the conductive connecting pieces, and such material has electrical-conductivity as a whole and elasticity; when the side surfaces of the chip contact heads on the cover come into contact with and press such conductive elastic material, such conductive elastic material may be deformed rapidly and cover the side surfaces of the chip contact heads to achieve flexible electrical connections between the side surfaces of the chip contact heads and the conductive connecting pieces, and in this case, contact areas of the side surfaces of the chip contact heads will become larger and more efficient, which further ensures good contacts between the side surfaces of the chip contact heads and the conductive connecting pieces, such conductive elastic material may be, for example, conductive elastic sponges, as shown in FIG. 35. In this figure, conductive connecting piece 64" includes: a front-end limit hole 642", an elastic sheet 641" stamped in the middle and a back-end contact surface 643", where functions and assembly and contact modes of parts of the conductive connecting pieces 64" are the same as those of the conductive connecting piece 64, the difference therebetween lies in that the back-end contact surface 643" of the conductive connecting piece 64" is adhered with a conductive elastic sponge 56. FIG. 36 shows a view where the side surfaces of the chip contact heads 13 on the cover of the laser printer come into contact with the conductive connecting pieces 64" adhered with the conductive elastic sponge 56 at the back ends thereof, where a plurality of conductive elastic sponges 56 are separated by a plurality of separators 661 extending from the push bar 66. When the plurality of conductive elastic sponges 56 is squeezed by side surfaces of the corresponding chip contact heads 13 on the cover, the separator 611 may prevent the plurality of conductive elastic sponges 56 from contacting with each other.

In Embodiments 1, 2 and 3 of the present invention as described above, in the case where components of the developing cartridge are designed properly, electrical connections may be achieved by direct contact of the memory terminals with the side surfaces of the chip contact heads, omitting the conductive connecting pieces, reference may be made to FIG. 37 for details, which shows a schematic diagram where the side surfaces 132 of the chip contact heads 13 on the cover of the laser printer come into contact with terminals 581 on the front surface of the chip 580.

In summary, contacts between the memory terminals on the developing cartridge and the side surfaces of the chip contact heads on the cover can be achieved according to technical solutions in Embodiments 1, 2 and 3 of the present invention, and reliability of the contacts increases, moreover, the developing cartridge has decreased vibration during a printing process, avoiding effects on the developing process, and ensuring stability of printing quality, thereby solving the problem of poor contacts between the chip terminals on the developing cartridge and the end surfaces of the chip contact heads on the cover, which is what is intended to be solved in the background, and meanwhile additionally solving the technical problem of shifting of a developing roller and a photosensitive drum due to vibrations and thus affecting the developing process and causing the printing quality unstable.

Feasible changes made by persons skilled in the art based on Embodiments 1, 2 and 3 of the present invention may also achieve the technical effects that the present invention aims to achieve, such as placing the conductive connecting pieces and the chip that are on the upper surface or the upper stepped surface of the developing cartridge on the back surface or the lower stepped surface of the developing cartridge, or reversing positions of the chip and the conductive connecting pieces on the upper or back surfaces or upper or lower stepped surfaces of the developing cartridge, then allowing the side surfaces of the chip contact heads on the cover of the laser printer to come into contact with the conductive connecting pieces on the back surface or the low stepped surface of the developing cartridge and press the developing cartridge upward.

What is claimed is:

1. A developing cartridge detachably installed into a printer, wherein a cover of the printer is provided with a plurality of chip contact heads, each of the chip contact heads is in a columnar shape and comprises an end surface and a side surface, the developing cartridge comprising:

a cartridge body, and a chip and a plurality of conductive connecting pieces provided on the cartridge body, wherein the cartridge body comprises an upper side that is facing up and a back side that is facing down when the developing cartridge is installed and inserted into the printer, wherein one end of each conductive connecting piece is connected to a chip terminal, and when the developing cartridge is installed and inserted into the printer and the cover is closed, the other end of the conductive connecting piece comes into contact with the side surface of a corresponding chip contact head on the cover of the printer based on a motion of closing the cover of the printer such that the side surface of the columnar-shaped chip contact head establishes an electrical connection between the conductive connecting piece and the chip contact head.

2. The developing cartridge according to claim 1, wherein the plurality of conductive connecting pieces are provided on the upper side of the cartridge body.

3. The developing cartridge according to claim 2, wherein a rear end of the upper side of the cartridge body has a stepped surface, and the plurality of conductive connecting pieces are provided on the stepped surface, and, when the developing cartridge is installed, the side surface of the plurality of chip contact heads on the cover of the printer contact with upper surfaces of the plurality of conductive connecting pieces.

4. The developing cartridge according to claim 3, further comprising: a chip holder, wherein the chip holder is provided on the stepped surface of the cartridge body, and the conductive connecting pieces and the chip are installed and fixed in the chip holder.

5. The developing cartridge according to claim 4, wherein the chip holder comprises a pair of supporting platforms, two rows of limit posts, elastic fixing buckles and elastic limit buckles; each of the conductive connecting pieces comprises: a front-end limit hole, a central protrusion and a back-end arch-shaped contact surface, wherein the limit hole faces the limit post of the chip holder and is socketed thereto, the supporting platforms support the chip and restrict the chip from moving forward and backward, and the chip terminals are in contact with the central protrusions on the conductive connecting pieces.

6. The developing cartridge according to claim 5, wherein the chip further comprises: stepped ends provided at both ends of the reverse side of the chip terminals, wherein the stepped end at one end is inserted into the elastic fixing buckle, the stepped end at the other end is pressed into the elastic limit buckle.

7. The developing cartridge according to claim 3, further comprising a chip holder, wherein the chip holder is provided on the back side of the cartridge body, and the chip is installed and fixed in the chip holder.

8. The developing cartridge according to claim 7, wherein the chip is provided with a notch, each of the conductive connecting pieces is provided with a circular I-shaped hole and a back-end contact surface, at a position corresponding to the chip holder, the upper stepped surface of the cartridge body is provided with a plurality of limit posts matching the number of the chip terminals and elastic limit buckles arranged in a row, spring holes and a screw hole which run through the upper stepped surface and the back side of the cartridge body are provided, the terminals on the front side of the chip face the spring holes and are provided in the chip holder, the chip is fixed in the chip holder by a screw passing through the screw hole, the spring passes through the spring hole with one end of the spring standing against the chip terminal, and the other end standing against the back-end contact surface of the conductive connecting piece, the circular I-shaped hole of each of the conductive connecting pieces is socketed to a corresponding limit post, and the back-end contact surface of each of the conductive connecting pieces is pressed into a corresponding elastic limit buckle.

9. The developing cartridge according to claim 7, wherein each of the conductive connecting pieces comprises: a front-end limit hole, an elastic sheet stamped in the middle and a back-end arch-shaped contact surface; at a position corresponding to the chip holder, the upper stepped surface of the cartridge body is provided with a press bar, and limit buckles arranged in a row, through holes and a screw hole which run through the upper stepped surface and the back side of the cartridge body are provided, the press bar locates at front end of each of the conductive connecting pieces, a plurality of limit posts matching the number of the chip terminals are provided at the back of the press bar, the front end of each of the conductive connecting pieces is inserted into the back of the press bar, the limit holes of the conductive connecting pieces are pressed and socketed to the limit posts of the press bar one by one, the limit posts and the conductive connecting pieces are in a hot-melt fixed connection, the elastic sheets pass through the through holes to stand against the chip terminals so as to achieve electrical connections between and the conductive connecting pieces and the chip.

10. The developing cartridge according to claim 9, wherein the chip further comprises: stepped ends provided at both ends of the reverse side of the chip terminal, and the chip holder further comprises a supporting platform, wherein the stepped end at one end of the chip is inserted into the supporting platform, and the stepped end at the other end is fixed in the chip holder by a screw passing through the screw hole.

11. The developing cartridge according to claim 2, further comprising a chip holder, wherein the chip holder is provided on the upper side of the cartridge body, and the conductive connecting pieces and the chip are installed and fixed in the chip holder.

12. The developing cartridge according to claim 11, further comprising limit posts, and receiving grooves, wherein the limit posts and the installation grooves are successively provided on the upper side of the cartridge body in compliance with rear ends of the conductive connecting pieces.

13. The developing cartridge according to claim 12, wherein each of the conductive connecting pieces further comprises: a rear end, a central I-shaped hole matching the limit post, and a protrusion in contact with the chip terminal.

14. The developing cartridge according to claim 13, wherein each of the conductive connecting pieces further comprises: a front-end bend portion for securing the conductive connecting piece, and barbed teeth provided on the front-end bend portion.

15. The developing cartridge according to claim 14, wherein the chip holder comprises:

a plurality of supporting platforms symmetrically provided at both ends of the chip holder, a plurality of limit blocks provided at a side adjacent to the supporting platforms, baffles, and slots of the conductive connecting pieces formed between adjacent limit blocks, wherein the limit blocks in the front of the chip holder and the baffles at three sides of the rear stand against the chip to restrict the chip from moving on all sides, the conductive connecting pieces are placed across the chip in turn, the front-end bend portions of the conductive connecting pieces are reversely inserted into the slots in the front of the chip holder in turn, the protrusions formed by stamping on the conductive connecting pieces abut joint with the chip terminals one by one, the central I-shaped holes of the conductive connecting pieces squeeze against and are socketed to the limit posts, and the rear ends of the conductive connecting pieces are placed in the receiving grooves.

16. The developing cartridge according to claim 12, wherein the chip holder comprises: a plurality of supporting platforms, a plurality of limit blocks, a plurality of baffles and a plurality of slots, symmetrically provided at both ends of the chip holder;

the chip comprises: terminals on a front side, notches, and protrusions at left and right ends;

each of the conductive connecting pieces comprises: a front-end bending protrusion, a central hole and a rear-end contact part;

wherein two limit blocks in the front of the chip holder match and are caught by the notches of the chip, the baffles at three sides of the rear stand against the chip to restrict the chip from moving left and right, the protrusions at the left and right ends of the chip are engaged with the slots in the chip holder, the rear-end contact parts of the conductive connecting pieces are provided in the receiving grooves, the central holes of the conductive connecting pieces are socketed to the limit posts one by one, and the front-end bending protrusions of the conductive connecting pieces abut joint with the chip terminals one by one, and press the chip downward to restrict the chip from moving up and down.

17. The developing cartridge according to claim 1, further comprising a push bar which is capable of standing against the end surfaces of the chip contact heads of the printer and imposing a backward push force on the chip contact heads of the printer.

* * * * *